US008727650B2

(12) United States Patent
Carroll et al.

(10) Patent No.: US 8,727,650 B2
(45) **Date of Patent: *May 20, 2014**

(54) RETRACTABLE SUBSTANCE DISPENSER

(76) Inventors: Craig Carroll, Newport Beach, CA (US); Steve Armstrong, San Juan Capistrano, CA (US)

( * ) Notice: Subject to any disclaimer, the term of this patent is extended or adjusted under 35 U.S.C. 154(b) by 473 days.

This patent is subject to a terminal disclaimer.

(21) Appl. No.: 12/776,800

(22) Filed: May 10, 2010

(65) Prior Publication Data

US 2011/0116857 A1 May 19, 2011

Related U.S. Application Data

(63) Continuation-in-part of application No. 11/873,288, filed on Oct. 16, 2007, now Pat. No. 8,215,857.

(51) Int. Cl.
*B43K 24/02* (2006.01)

(52) U.S. Cl.
USPC ..... 401/107; 401/108

(58) Field of Classification Search
CPC ..... A61Q 1/00; A61Q 1/06; A61Q 1/10
USPC ..... 401/107–109, 202, 213, 243–248
See application file for complete search history.

(56) References Cited

U.S. PATENT DOCUMENTS

| | | | | |
|---|---|---|---|---|
| 3,359,992 | A | 12/1967 | Cishek et al. | |
| 5,048,990 | A | 9/1991 | Hashimoto et al. | |
| 5,171,096 | A | 12/1992 | Perrotti | |
| 6,231,256 | B1 * | 5/2001 | Kingsford et al. | 401/108 |
| 6,283,658 | B1 | 9/2001 | Estevez et al. | |
| 6,554,516 | B1 | 4/2003 | Christopher | |
| 6,623,200 | B1 * | 9/2003 | Gueret | 401/129 |
| 7,331,730 | B2 | 2/2008 | Fukui et al. | |
| 8,215,857 | B2 * | 7/2012 | Carroll | 401/107 |
| 2004/0184865 | A1 | 9/2004 | Carroll | |
| 2006/0002756 | A1 | 1/2006 | Kageyama et al. | |
| 2007/0166095 | A1 | 7/2007 | Samuelson et al. | |
| 2008/0175648 | A1 | 7/2008 | Hayes et al. | |
| 2009/0245919 | A1 | 10/2009 | Rennecker et al. | |

OTHER PUBLICATIONS

PCT/US2008/074958 form237, Nov. 18, 2008, Carroll.
PCT/US2008/074957 form237, Nov. 18, 2008, Carroll.

* cited by examiner

*Primary Examiner* — Davis Hwu
(74) *Attorney, Agent, or Firm* — John K. Buche; Buche & Associates, P.C.

(57) ABSTRACT

Disclosed is a cosmetic dispenser comprising a reservoir configured to hold a substance; an applicator selectively extendable or retractable from the dispenser; and, means for ejecting the substance in the reservoir through the applicator. Also disclosed are methods related to the use of the cosmetic dispenser.

19 Claims, 16 Drawing Sheets

209
201
211
205
207
204
210
203
117
118
222
115
202

201
211
207
205
209
210

203
201
222
218
217
215
202
211
204
207
205
213

RETRACTABLE SUBSTANCE DISPENSER

CROSS-REFERENCE TO RELATED APPLICATIONS

This application claims the benefit of U.S. patent application Ser. No. 11/873,288 (filed Oct. 16, 2007) as a continuation in part thereof. The above identified application is hereby incorporated by reference.

STATEMENT REGARDING FEDERALLY SPONSORED RESEARCH OR DEVELOPMENT

N/A

BACKGROUND OF THE INVENTION

1. Field of Invention

The present application is in the field of apparatus for dispensing cosmetic substances.

2. Background of the Invention

The ideal cosmetic dispenser is non-messy, portable, capable of storage, rapid delivery and easy application of a cosmetic substance. Typical cosmetic dispensers have a substance compartment whose contents may be emitted or placed onto an applicator for cosmetic application.

Ordinarily, cosmetics dispensers come equipped with a detachable lid or cap that is pulled or twisted off from the dispenser to expose the applicator. The purpose of the lid is to protect the applicator from outside corruption and prevent unintentional transfer of substance away from the applicator. One problem with this type of dispenser is that a contained substance can be wasted through inadvertent expulsion into the lid. Another problem with this type of dispenser arises through unmindful removal or replacement of the lid over the applicator since the substance invariably smears to the outside or the attaching portion of the lid. When this happens, subsequent lid removal becomes increasingly difficult and the cosmetic substance unwittingly dirties the dispenser user's hands. It is also difficult, with the traditional dispenser to maintain a sanitary applicator. Another drawback for this type of dispenser is that it requires two hands to remove the lid. Yet another problem is that the removable cap can easily be lost.

Cosmetic dispensers typically have some method to accomplish substance expulsion. Ordinarily, expulsion is triggered by manually twisting a driver, or by squeezing the compartment. However, twisting is undesirable because it takes two hands and is time consuming. Squeezing is undesirable because the amount of substance emitted is not easily metered, and can lead to substance waste because squeezing does not easily remove all the substance from the containing compartment.

SUMMARY OF THE INVENTION

Accordingly, it an objective of the present application to provide a cosmetic dispensing apparatus featuring a retractable applicator that permits elective exposure or concealment of the applicator.

It is a further object of the present application to provide a dispensing apparatus which allows elective expulsion of a substance while the applicator is exposed.

It is yet a further object of the present application to provide a dispensing apparatus without a detachable lid or cap, but which apparatus still protects the applicator from outside corruption.

It is yet a further object of the present application to provide a dispensing apparatus which may be used sufficiently with one hand.

BRIEF DESCRIPTION OF THE FIGURES

Other objectives of the invention will become apparent to those skilled in the art once the invention has been shown and described. The manner in which these objectives and other desirable characteristics can be obtained is better explained in the following description and attached figures in which.

Figure 1:
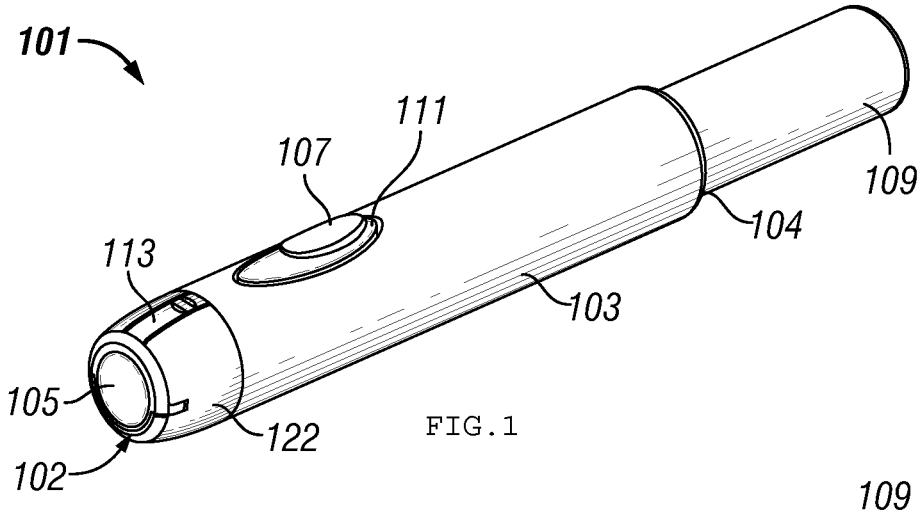
FIG. 1 is a perspective view of a preferred embodiment of a dispenser 101 in a closed configuration.

It is to be noted, however, that the appended figures illustrate only typical embodiments disclosed in this application, and therefore, are not to be considered limiting of its scope, for the invention may admit to other equally effective embodiments that will be appreciated by those reasonably skilled in the relevant arts. Also, figures are not necessarily made to scale.

DETAILED DESCRIPTION OF PREFERRED EMBODIMENTS

The dispenser 101 of the present application usually has an enclosure capable of containing substances and a suitably placed applicator 117 which acts as avenue from an enclosure to an applicator tip 118. Additionally, there is typically a means for inducing movement of the stored substance along the applicator shaft 115, culminating with expulsion of contained substance through an applicator tip 118. The applicator 117 (usually featuring an applicator tip 118 and an applicator shaft 115) of this dispenser 101 is suitably retractable, or extendable, and operationally configured to be concealed internally until electively exposed for use, and then electively re-concealed.

FIG. 1 depicts a dispenser 101 in a closed configuration. The figure shows a dispenser body 103 featuring a slit 111 preferably situated around a lever 107, which lever 107 suitably defines an excrescence on the dispenser body 103. FIG. 1 also shows the anterior of the dispenser body 103 suitably occupied by a cap 105 and cap housing 122 which may variably seal the anterior opening 102 of the dispenser 101. The posterior of the body 103 is suitably occupied by a plunger 109 that typically coaxially merges into (or with) the body 103 by way of the posterior opening 104. In FIG. 1, the plunger 109 represents a deactivated trigger and the anterior opening 102 represents an exit location for the applicator 117. As detailed below, the lever 107 is an inactive reversion means, meaning that it may function to release the applicator 117 from a fixed extended position, allowing it to be selectively retracted by the user into the body 103 of the dispenser 101 (as depicted in FIG. 1). Also detailed below, in FIG. 1 the cap housing 122, body 103, and plunger 109 have various internally concealed components.

Figure 2A:
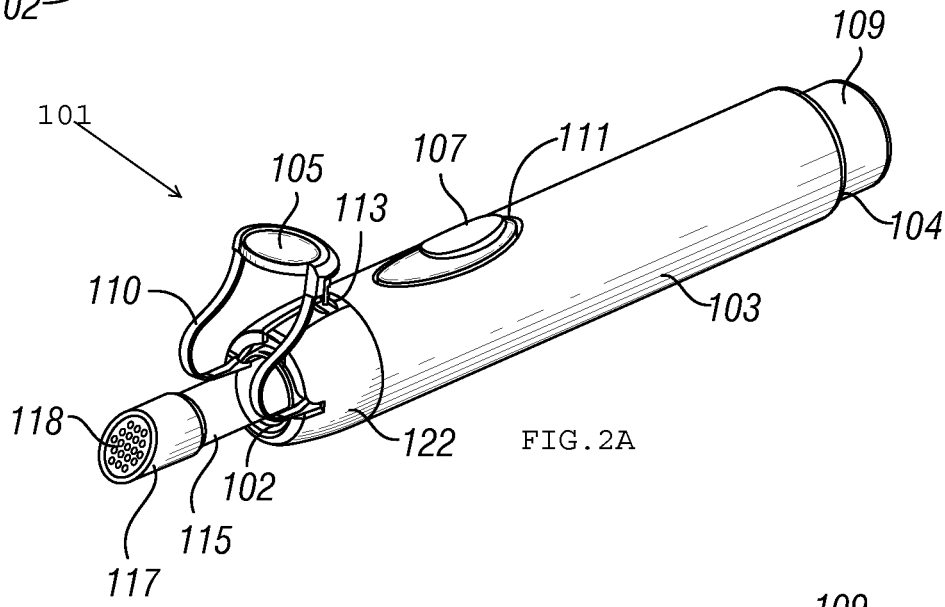
FIG. 2A is a perspective view of the dispenser 101 of FIG. 1 in an open configuration.

FIG. 2A typifies a dispenser 101 in an open configuration. The figure illustrates a cap 105 held open and away from anterior opening 102 by a pair of rigid, yet flexible, cap shoots 110 and a flexor 113. FIG. 2A also depicts the protrusion of an applicator 117 through the exposed anterior opening 102. An activated lever 107 is accessible at slit 111, and a partially depressed plunger 109 extends from the posterior opening 104. In FIG. 2A, the anterior opening 102 is the exit location for applicator 117. As detailed further below, the lever 107 is suitably an activated reversion means because interaction therewith may result in the reversion of the dispenser into the closed configuration depicted in FIG. 1. Also detailed below, in FIG. 2A the cap housing 122, body 103 and plunger 109 have various internal components.

Referring to FIGS. 1 and 2A, the dispenser 101 of the present application has a suitably retractable applicator 117 which may be electively exposed for applicator tip 118 use. Elective transition from a closed to an open configuration is usually achieved through application of an initiating force which suitably activates the plunger 109 as a trigger, exposes anterior opening 102, and protrudes the applicator 117 from the dispenser 101. In most instances, the acting force on the plunger 109 will be generated by the user manually, for instance by a thumb or finger. The dispenser 101 typically has a natural tendency to revert from an open to a closed configuration. As discussed further herein, during transition from closed to open configurations, this tendency is normally continuously opposed to applicator 117 protrusion and plunger 109 activation.

However, once the plunger 109 has been activated, the applicator 117 is suitably locked in external position and natural reversion of the dispenser 101 to a closed configuration is prevented. Also discussed further herein, once the dispenser 101 is suitably locked into an open configuration, the lever 107 suitably becomes an activated reversion means which may electively be acted upon to release the lock, thereby enabling the aforementioned natural tendency to actuate reversion to a closed configuration. FIGS. 1 and 2A taken together may help visualize this transition. Referring to these two figures, when an external axial force is applied to the butt of the plunger 109 in FIG. 1, such force depresses the plunger 109, extrudes cap shoots 110 from cap housing 122, releases the cap 105 along flexor 113, and projects applicator 117 from the anterior opening 102. Once the force moves the plunger 109 to its partially depressed position in FIG. 2A, plunger 109 and lever 107 are activated and the configuration is usually locked in place. At this point, reversion to the closed state of FIG. 1 normally can only be attained through interaction with lever 107. See the discussion below for more details.

Figure 2B:
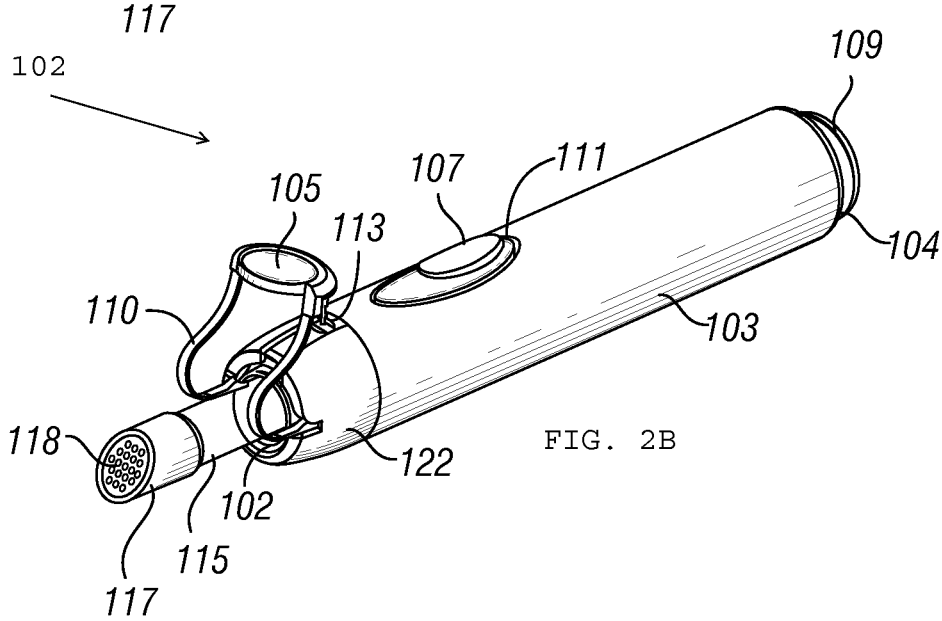
FIG. 2B is a perspective view of the dispenser 101 of FIG. 1 in an open and dispensing configuration.

FIG. 2B depicts a dispenser 101 in an open and dispensing configuration. The FIG. 2B configuration is suitably necessary for expulsion of contained substance through an exposed applicator tip 118. As seen in the figure, a dispenser 101 in such an open and dispensing configuration has components in roughly the same relative positions as that of FIG. 2A, but the plunger 109 is suitably depressed fully toward the body 103. In other words, the depressed and active plunger 109 may be typically used as an active trigger to forcibly eject cosmetic substance from an applicator tip 118 of the dispenser 101.

Transition from an open (FIG. 2A) to an open and dispensing (FIG. 2B) configuration is usually accomplished by a motive force placed upon the contained substance. The motive force may preferably be caused by the plunger 109 being fully depressed and active. A fully depressed and active plunger 109 typically results from axial impulse on the end of the activated plunger 109 (FIG. 2A). As discussed in more detail below, this impulse preferably induces metered dispensing of a contained substance from the exposed applicator tip 118. Applicator 117 may feature at least one, or a plurality of orifices through which substance may be expelled. Dissipation of the aforementioned impulse results in reversion of the plunger 109 from fully (FIG. 2B) to partially depressed (FIG. 2A) and suitably ends dispensing of substance until a new impulse is triggered. Usually there is no mechanism to lock the dispenser in an open and dispensing configuration. FIGS. 2A and 2B together may help visualize this process. Referring to these two figures, when an external axial impulse is applied to the butt of the plunger 109 in FIG. 2A, this impulse usually fully depresses the plunger 109 to its position in FIG. 2B which induces metered expulsion of a contained substance from applicator tip 118. Upon dissipation of the axial impulse, the fully depressed plunger 109 of FIG. 2B preferably automatically returns to its position in FIG. 2A. A typical use cycle would entail impulsive depression of the plunger 109 from its partially depressed position in FIG. 2A to a fully depressed position of FIG. 2B, followed by reversion to its partially depressed position in FIG. 2A. Normally, the cosmetic dispensing feature of dispenser 101 is accomplished by the plunger 109 being cycled repeatedly to cause sufficient accumulation of contained substance at the applicator tip 118, where a user would then apply the substance to the lips, eyes, face, or the like.

Still referring to FIGS. 2A and 2B, the specifics of the applicator 117 (usually including the applicator shaft 115 and applicator tip 118) depend on the type of substance and the nature of the dispenser 101 purpose. In the accompanying figures, the applicator 117 is a hollow truncated cylinder with an angled cylindrical section as the applicator tip 118 surface, as one might see in a lip gloss applicator. In some instances, however, the applicator tip 118 may just be an orifice or other type of opening through which a substance may be discharged. In another instance, the applicator tip 118 may be a membrane through which substance may be expelled. In yet another instance, the applicator tip 118 may be some type of rigid member to which expelled substances may adhere while awaiting application (e.g., a brush for mascara).

Figure 3A:
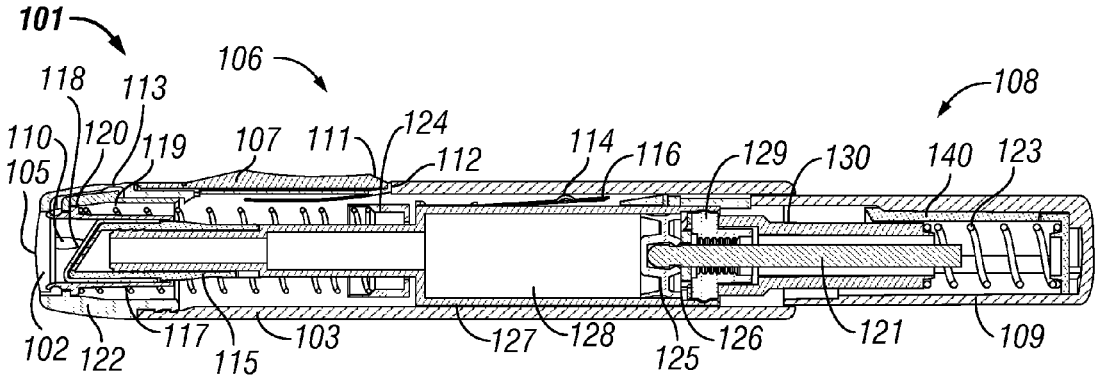
FIG. 3A is a longitudinal cross-section of the dispenser 101 of FIG. 1.
Figure 3B:
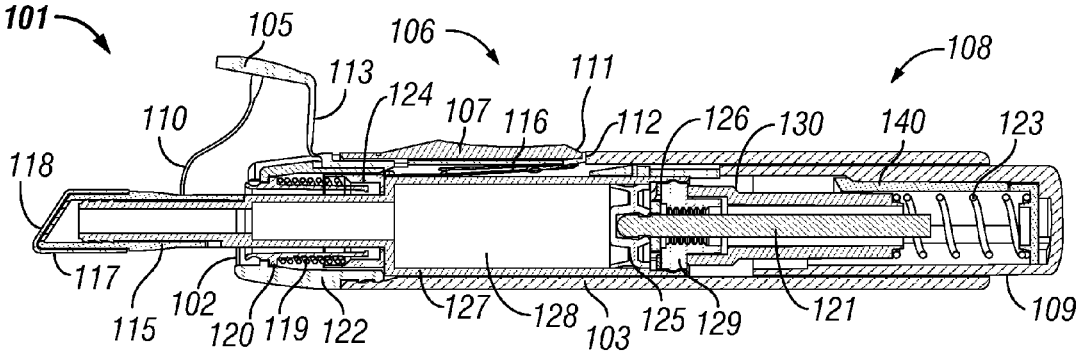
FIG. 3B is a longitudinal cross-section of the dispenser 101 of FIG. 2.
Figure 4:
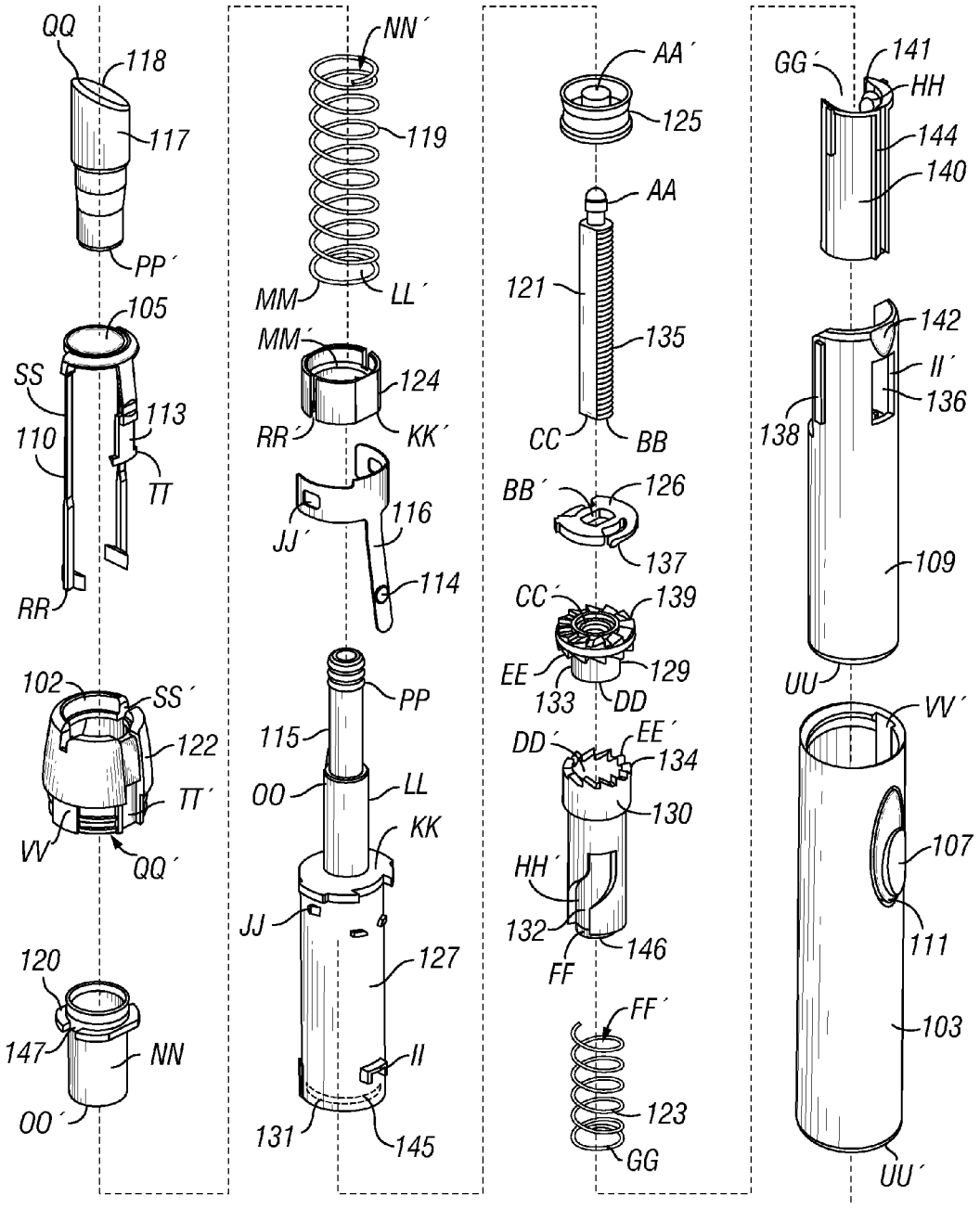
FIG. 4 is an exploded view of the dispenser 101 of FIGS. 1 through 3C.
Figure 5:
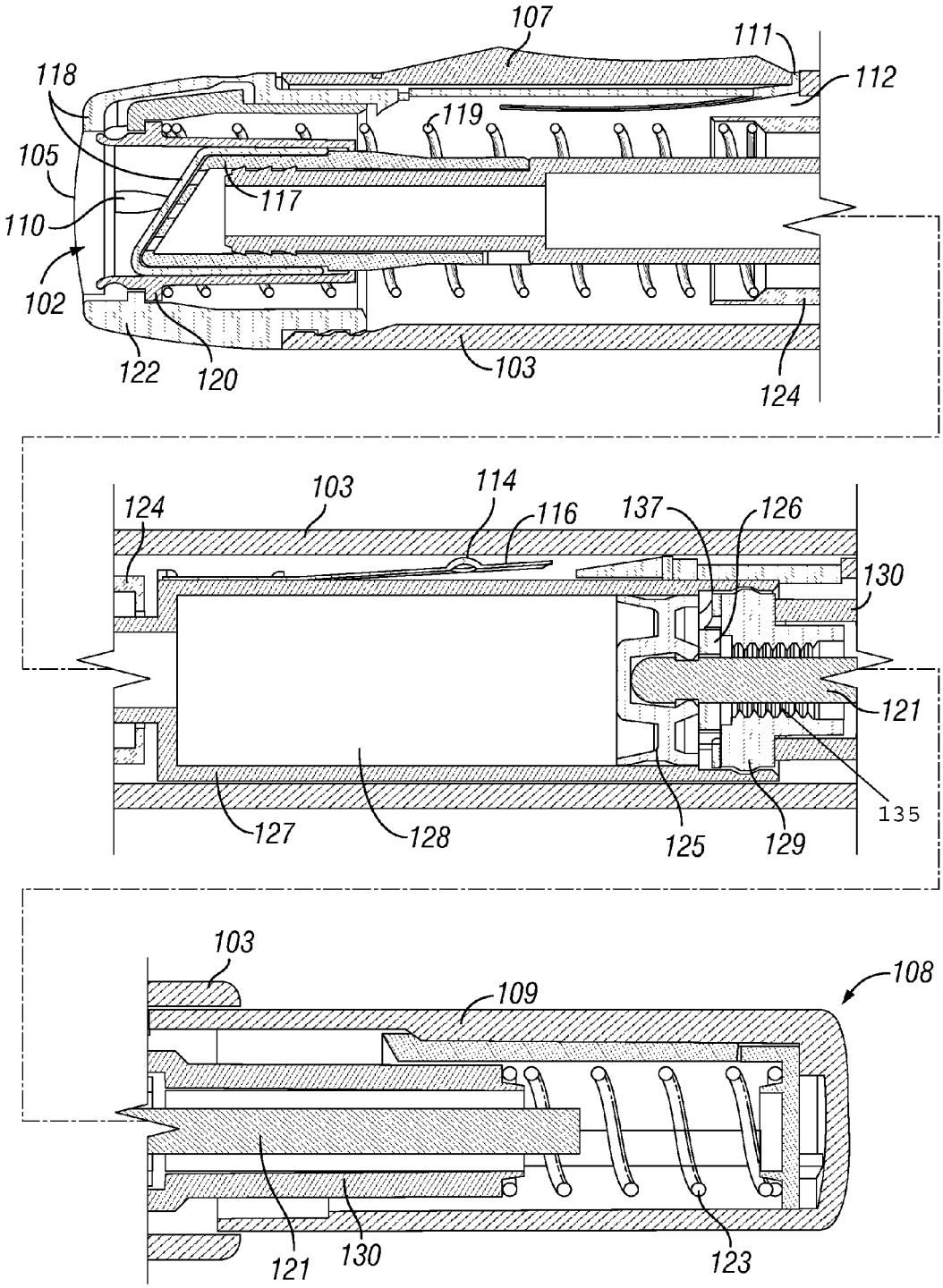
FIG. 5 is an enlarged longitudinal cross-section of the dispenser 101 of FIG. 1 in a closed configuration.
Figure 6:
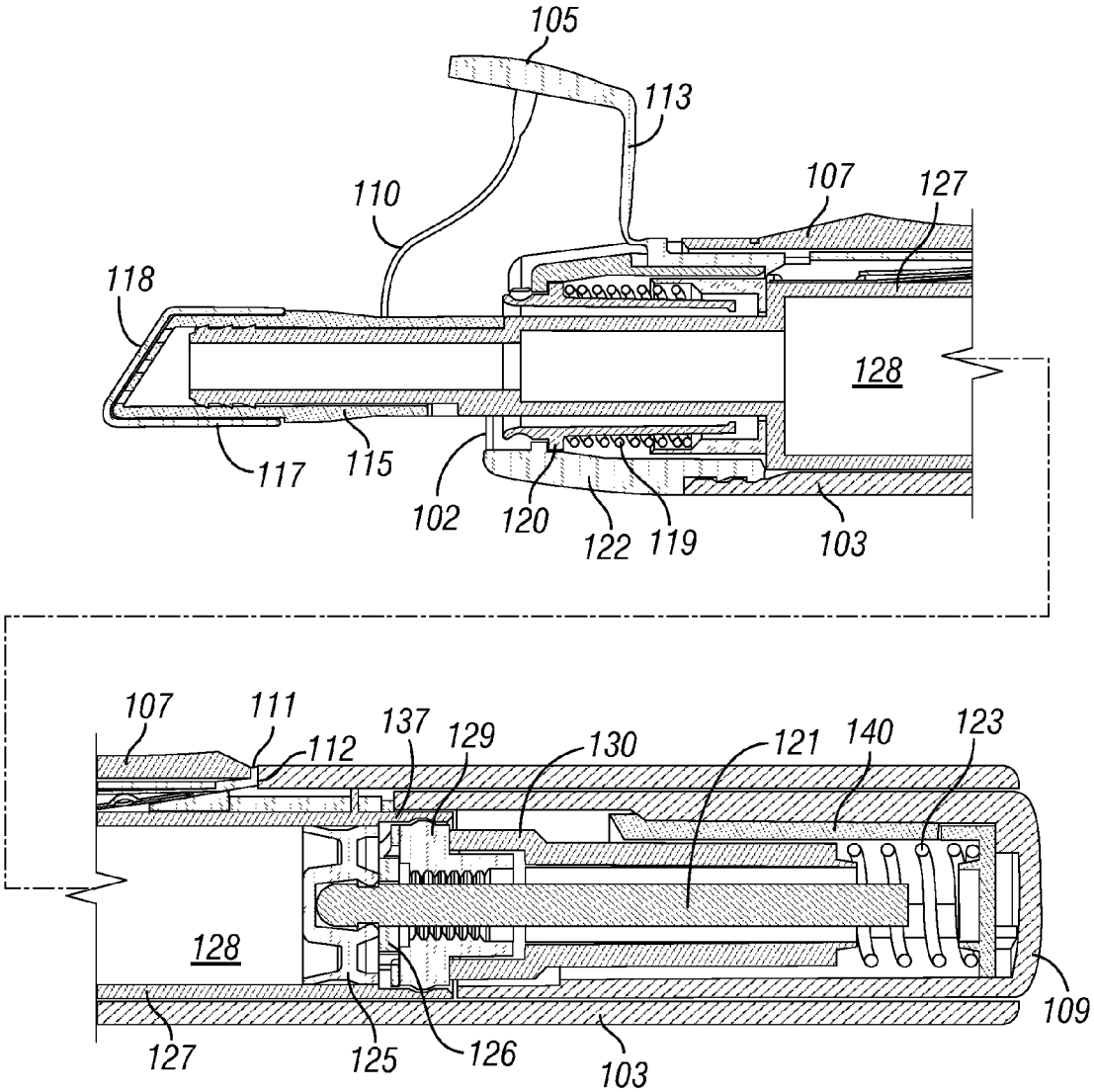
FIG. 6 is an enlarged longitudinal cross-section of the dispenser 101 of FIG. 5 in an open and dispensing configuration, with applicator 117 exposed, and with a plunger 109 fully depressed.

FIG. 3A (FIG. 5 is an enlarged view) is a longitudinal cross-section of the dispenser 101 of FIG. 1. (since the components are depicted in cross-section, the specific features of the internal components are better viewed in FIG. 4 which is an exploded view of the dispenser 101). The figure shows a dispenser 101 with a closed cap 105 and body hollow 106 which houses the applicator 117 including the applicator shaft 115 and applicator tip 118, the retraction spring 119, the cap shoots 110, the shoot press 124, the contracted arm 116, ledge 112, a movable reservoir body 127 (which contains the piston 125, and part of the plunger shaft 121), resistor 126, drive gear 129, and crank 130. The figure also shows a dispenser 101 with a plunger cavity 108 that houses the plunger spring 123, the crank housing 140, and most of the plunger shaft 121, drive gear 129 and crank 130. In FIG. 3A the plunger 109 is fully extended away from the body 103 and the internal components of the body hollow 106 are toward the body 103 posterior. The reservoir body 127 and its chamber 128 are an enclosure configured to contain cosmetic substances, which are usually fluid or powder in nature. Typical substances include, but are not limited to, lipstick, mascara, lip gloss, blemish remover, concealers, eyeliners, and the like as will be appreciated by those skilled in the industry. The applicator shaft 115 suitably defines an avenue or channel between the applicator tip 118 and the chamber 128 containing substance. In other words, the applicator shaft 115 and chamber 128 are suitably in fluid connection with one another FIG. 3B (FIG. 6 is an enlarged view) is a longitudinal cross-section of the dispenser 101 of FIG. 2A (since the components are depicted in cross-section, the specific features of the internal components are better viewed in FIG. 4 which is an exploded view of the dispenser 101). The figure illustrates the following components: a cap 105 held open and away from anterior opening 102 by a pair of rigid, yet flexible, cap shoots 110 and a flexor 113; and, applicator 117 (which usually includes applicator tip 118 and applicator shaft 115) protruding through exposed anterior opening 102. The body hollow 106 houses the retraction spring 119 which is compressed against the spring stop 120; the shoot press 124 which has pushed the cap shoots 110 through the cap housing 122; the arm 116 extended to the ledge 112; and the reservoir body 127, which is locked in its position and which contains the piston 125 and part of the plunger shaft 121, resistor 126, drive gear 129, and crank 130. The figure also shows a dispenser 101 with a plunger cavity 108 that houses the plunger spring 123, idle plunger shaft 121, resistor 126, drive gear 129, and crank 130. In FIG. 3B the activated plunger 109 is more depressed toward the body 103 than the deactivated plunger 109 of FIG. 3A and the internal components of the body 103 hollow 106 are more toward the body 103 anterior.

Figure 3C:
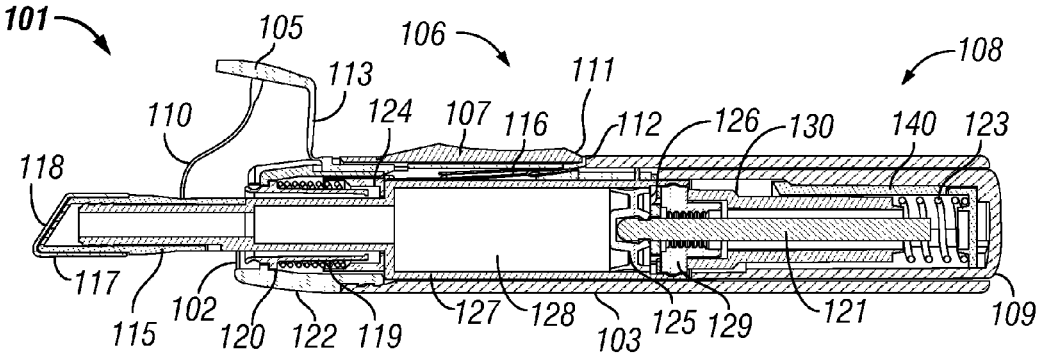
FIG. 3C is a longitudinal cross-section of the dispenser 101 in an open and dispensing configuration, with applicator 117 exposed, and with a plunger 109 fully depressed.

FIG. 3C is a longitudinal cross-section of the dispenser 101 in a open and dispensing configuration (since the components are depicted in cross-section, the specific features of the internal components are better viewed in FIG. 4 which is an exploded view of the dispenser 101). FIG. 3C is the same as FIG. 3B except the figure shows a dispenser 101 with a fully depressed plunger 109 and plunger cavity 108 which houses the compressed plunger spring 123, the working plunger shaft 121, resistor 126, piston 125, drive gear 129 and crank 130. In FIG. 3C the plunger 109 is more depressed than the plunger 109 of FIG. 3B.

As mentioned above, a dispenser 101 transition from a closed to open configuration is opposed by a natural tendency to remain in, and revert to, a closed configuration. FIGS. 3A and 3B provide an illustration of such a natural tendency.

These figures show a dispenser 101 with a retraction spring 119. FIG. 3A depicts the retraction spring 119 while the dispenser 109 is in a closed configuration. In transitioning from the dispenser 101 of FIG. 3A to that shown in FIG. 3B, after the cap 105 has opened, the applicator 117 suitably protrudes through the anterior opening 102 and the retraction spring 119 partially compresses against spring stop 120, which causes a continuous opposing force to the applicator 117 protrusion. Plunger 109 is activated by depression from its position in FIG. 3A to its position in 3B, which plunger 109 depression accomplishes at least the following: (1) moves the reservoir body 127, shoot press 124, and arm 116 toward the anterior; (2) extrudes the cap shoots 110 through cap housing 122 to open cap 105, and guided by flexor 113; (3) drives the applicator 117 protrusion; and, (4) suitably compresses the spring to its position in FIG. 3B. The force of compressed retraction spring 119 is constantly opposed to plunger 109 activation and applicator 117 protrusion.

Though the figures depict retraction spring 119 as the natural tendency, an internal compression spring is not the only means for inducing the aforementioned natural tendency. Such natural tendency may be invoked internally or externally through the use of magnets, elastics, rubbers, manual or any other attractive or repulsive force.

As mentioned above, until dispenser 101 is locked into the open configuration, the natural tendency will suitably invoke reversion to a closed configuration. The dispenser 101 of the present application typically uses a suitable latching means to lock the open configuration when the applicator 117 has been protruded sufficiently from the anterior opening 102. The latching means may remove the natural tendency or suitably counteract the force. FIGS. 3A and 3B provide illustrations of a latching means in operation. FIG. 3B depicts an arm 116 extending from the reservoir body 127 that fixes to a ledge 112 notched into an inner wall of the body 103 just below the slit 111. FIG. 3A shows this arm 116 contracted while the dispenser 101 is in a closed configuration. Application of an axial initiating force at the plunger 109 butt, depresses the deactivated plunger 109 of FIG. 3A, and moves the arm 116 toward ledge 112 below slit 111. FIG. 3B shows arm 116 levered against the ledge 112 such that compressed retraction spring 119 cannot expand to force the dispenser 101 to a closed configuration.

Though the figures depict extended arm 116 and ledge 112 as the latching mechanism for dispenser 101, there are many other suitable latching means. This latching means might take the form of a hook, lever, constriction, latch, adhesive, friction, and by other means that would be appreciated by those skilled in the art.

The plunger 109 becomes an activated trigger when further depression accomplishes expulsion of contained substance from the exposed applicator 117 at the applicator tip 118. To prevent undesired and unintentional internal ejection of contained substance at the applicator tip 118, the plunger 109 is not used to eject substance until the dispenser 101 is in the open configuration. FIGS. 3A and 3B provide an illustration of plunger 109 activation. As mentioned above, the deactivated plunger 109 of FIG. 3A may be depressed by an initiating force until extended arm 116 meets ledge 112 to lock the dispenser in its FIG. 3B configuration. Beginning at FIG. 3A, an initiating force applied to the butt of deactivated plunger 109 moves at least one of the reservoir body 127, shoot press 124, and contracted arm 116 from a posterior position to an anterior position as seen in FIG. 3B. During depression, the retraction spring 119 compresses against spring stop 120, the cap shoots 110 extrude out of the cap housing 122, the cap shoots 110 force open the cap 105 while the flexor 113 guides the cap 105 away from anterior opening 102, and the applicator 117 (which usually includes applicator shaft 115 and applicator tip 118) protrudes from the body 103 and cap housing 122 through anterior opening 2. When locked in this open configuration, the plunger 109 is activated because further plunger 109 depression induces substance movement along applicator shaft 115 culminating with ejection through the applicator 117, suitably by way of the applicator tip 118.

A lever 107 becomes an activated reversion switch when action upon it results in reversion from an open to closed configuration. A lever 107 as a reversion switch is a suitable means for unlocking the open configuration. FIGS. 3A and 3B illustrate the activation of a lever 107 as a reversion switch. In FIG. 3B, arm 116 interacts with ledge 112 just below the slit 111 to prevent retraction spring 119 from expanding from its compressed state. While arm 116 is interacting with ledge 112, lever 107 deflection is required to dissociate the arm 116 from the ledge 112 and thereby effectuate reversion of dispenser 101 to a closed configuration. Importantly, the protuberance 114 is usually designed to allow smooth transition from a closed dispenser 101 configuration to an open configuration and vice versa. In other words, the protuberance 114 does not usually extend distally from the arm 116 to a degree or to the extent that would allow the protuberance 114 to interact with the other internal components or features of the dispenser 101 in a manner that blocks or hinders transition between dispenser 101 configurations. Rather, the protuberance interacts with the internal surface of body 103 to prevent the distal end of arm 116 from snagging thereon while contracted. In the open configuration, the lever 107 of FIG. 3B is an activated reversion switch because acting on it contracts arm 116, and allows retraction spring 119 to push the exposed applicator 117 (which usually features an applicator shaft 115 and an applicator tip) back within the body to the FIG. 3A configuration. The lever 107 in FIG. 3A is inactive because acting on it does not result in reversion. Finally, as mentioned above, lever 107 suitably defines an excrescence on the body 103 in order that lever 107 may be more readily identified whether by sight or feel. However, the degree or extent of desirable excrescence will vary and change depending on desired dispenser 101 use and in some instances a lever 107 may be flush with the body 103 surface and not define an excrescence at all. Such details will be apparent to those skilled in the art. Though the figures depict the lever 107 in association with slit 111 as a reversion switch, anything that releases the dispenser 101 latching means may be used as a reversion switch.

Another feature of the dispenser 101 is the cap 105 which, in conjunction with an elastomeric spring stop 120 and the applicator shaft 115, electively seals or unseals the anterior opening 102, typically by way of a substantially air or water tight pocket. FIGS. 1, 2A, 3A and 3B (and FIG. 4 for views of the internal components) provide an illustration of the cap 105 in operation. While dispenser 101 is in a closed configuration like that of FIGS. 1 and 3A, the cap 105 suitably seals the anterior opening 102 of the dispenser 101 as follows: the retraction spring 119 is fully extended and preferably forces the shoot press 124 to abut the reservoir body 127 at one end, and the presses the spring stop against cap housing 122 on the other end; the shoot press 124 suitably pulls the cap shoots 110 taut, which tension usually interlocks the cap 105 with the cap housing 122 and secures the cap 105 over the anterior opening against the anterior of spring stop 120; the tension on the cap shoots 110 between the shoot press 124 and the cap 105 suitably squeezes the spring stop 120 between the cap 105 and the cap housing 122 thereby forcing deformation of the elastomeric spring stop 120 until the anterior opening 102 is substantially air or water tight; and finally, at the posterior of the spring stop 120, the applicator shaft 115, which is coaxial to the spring stop 120 and which has an increasing diameter toward the applicator 117, forces deformation of the posterior of the spring stop 120 by way of its increasing diameter relative to the diameter of the spring stop 120 (see FIG. 3A). Accordingly, a substantially air or water tight pocket is created between the cap, the spring stop 120 and the applicator shaft 115. Other sealing means preferably may be placed throughout the dispenser 101 to effectuate an optional air or water tight dispenser 101. As illustrated by FIGS. 3A and 3B, to unseal the cap 105, plunger depression moves the reservoir body 127 and shoot press 124 internally toward the anterior opening 102, the shoot press forces the cap shoots 110 through the cap housing 122, and the cap 105 is forced off of the anterior opening 102 by the cap shoots 110 and drawn away by the flexor 113. Also, as the tip 118 is exposed from anterior opening 102, the decreasing diameter of the applicator shaft 115 relative to the posterior of the spring stop 120 permits the elastomeric spring stop 120 to return to equilibrium (see FIG. 3B or 3C). A substantially air or water tight pocket at the anterior opening is useful to prevent contamination, corruption, or dehydration/drying of the tip 118 and contained substance. Additionally, attached to distal end of the flexor 113 is a hook which interacts with cap housing 122 to extend the useful life the seal. The flexor 113 slides forward with the cap shoots 110 when the plunger 109 is pressed, and the hook stops at the base of the cap housing 122 when the cap is open as illustrated in FIGS. 3B and 3C. This feature typically allows the cap 105 to come down evenly on the seal surface of spring stop 120 without applying to much pressure to one side of the elastomeric spring stop 120 and possibly deforming it over time.

The dispenser 101 of the present application normally ejects a substance through the exposed applicator 117 at the applicator tip 118 after an impulse has sufficiently depressed a plunger 109 and induced movement of a contained substance along an applicator shaft 115 between the applicator tip 118 and the chamber 128. Movement of said contained substance along the applicator shaft 115 may be realized by a piston, pump, suction, expansion, compression or otherwise as will be appreciated by those skilled in the art. As described below, FIGS. 3B and 3C (and FIG. 4 for views of the internal components) illustrate a typical dispensing process for the dispenser 101.

If an axial impulse is suitably applied to the butt of the activated plunger 109 shown in FIG. 3B, the plunger 109 further depresses until it is fully depressed as depicted by FIG. 3C, after which the plunger 109 reverts to its FIG. 3B position. During this complete depression and reversion of the plunger 109, the idle crank 130 of FIG. 3B changes into the working crank 130 of FIG. 3C usually as follows: (1) the crank housing 140 and associated crank guide 141 suitably advance toward the reservoir body 127; (2) the crank guide 141 traverses crank path 132 which axially torques the crank 130 relative to the reservoir body 127 because grip 144 interacts with channel 143 to prevent the crank housing 140 and associated crank guide 141 from axially rotating relative to the reservoir body 127; (3) the crank housing 140 and associated crank guide 141 suitably retreat away from the reservoir body 127; and, (4) the crank guide 141 reverses crank path 132 which axially torques the crank 130 in the opposite direction relative to the reservoir body 127 because grip 144 and channel 143 prevent the crank housing 140 and associated crank guide 141 from axially rotating relative to the reservoir body 127.

At the immediate anterior of the reservoir body 127 is housed the driver 129 and resistor 126 which are suitably held in longitudinal position relative to the reservoir body 127 by the drive path 131 and resistor path 145 respectively. The resistor 126 is fixed axially (may not traverse resistor path 145), while the driver may rotate axially (may traverse drive path 131). In other words, the driver 129, but not resistor 126, may rotate axially relative to the reservoir body 127, while both suitably do not move longitudinally from their position at the anterior of the reservoir body 127. The driver 129 has driver teeth 133 on its lower side which interlock with the crank teeth 134 while the crank guide 141 is traversing crank path 132 during activated plunger 109 depression. The driver teeth 133 and crank teeth 134 functionally disengage while the crank guide 141 is reversing crank path 132 during dispenser reversion from an open and dispensing configuration (FIG. 4C) to an open configuration (FIG. 3B). A working crank 130 torques the driver 129 relative to the reservoir body 127 and resistor 126 as the crank guide 141 traverses crank path 132 because the crank teeth 134 and driver teeth 133 are suitably interlocked, thereby inducing driver 129 rotation simultaneously and to the same degree as the crank 130. Though the crank 130 rotates in the opposite direction as the crank guide 141 reverses crank path 132, the driver 129 does not, because usually the crank teeth 134 and driver teeth 133 are functionally disengaged and because of a resister 126. The resister 126 sits adjacent to the driver 129 in resistor path 145. The resistor 126 typically features resister digits 137 that interact with digit grips 139 on the facing surface of the driver 129 to allow the driver 129 to rotate simultaneously with the crank 130 around driver path 131 as crank guide 131 traverses crank path 132, but to disallow driver 129 rotation in the opposite direction as crank guide reverses crank path 132. Consequently, as dispenser 101 reverts to its open configuration, crank teeth 134 and driver teeth 133 may suitably slide past each other and reset for subsequent depression of the plunger 109 and associated driver 129 rotation. Though the figures depict driver teeth 133 and crank teeth 134 with profiles are cooperating right triangles, those skilled in the art will know various other mechanisms for accomplishing the same task. Though the resistor 126 features digits 137 which are bendable appendages which interact with grips 139 having a profile of a right triangle, those skilled in the art will know various other mechanisms for accomplishing the same task.

A rotating driver 129 is a working driver 129 because, as it rotates, cooperating grooves 135 on the driver 129 and plunger shaft 121 interface and interact to coaxially screw the plunger shaft 121 into the reservoir body 127. Because resister 126 only permits driver 129 rotation in one direction, the plunger shaft 121 is not suitably unscrewed from its position within the reservoir body 127. Each repeated depression of the activated plunger 109 drives the plunger shaft 121 incrementally further into the reservoir body 127. As a result, the idle piston 125 of FIG. 3B changes into the working piston of FIG. 4C because the piston moves incrementally further into the reservoir body 127. As the plunger shaft 121 is incrementally driven into the reservoir body 127, it pushes the piston 125 from the posterior of the chamber 128 toward the anterior of the reservoir body 127, thereby decreasing the effective volume of the chamber 128, and at the same time, moving the contained substance along the applicator shaft 115 toward expulsion at the applicator tip 118.

As mentioned above, the dispenser 101 of the present invention contemplates that the amount of contained substance induced to move by a single plunger 109 depression may be set by the dispenser 101 manufacturer. The parameters of crank path 132 and the pitch of plunger shaft 121 determine the degree of rotation achieved by the crank 130 and therefore, the distance which plunger shaft 121 is screwed and the piston 125 is driven into the reservoir body 127. Knowing this distance, with the geometric configuration of the chamber 128 and the thread pitch of plunger shaft 121, allows the volume of substance expelled at the tip 118 during a single plunger 109 depression to be determined. Metered movement of substance is important because the manufacturer can predict the life of a dispenser 101 and adjust its retail stock accordingly (whether dispenser 101 is disposable or refillable). Moreover, metered movement of substance is important in that globbing, or over accumulation of substance at the tip 118 can more easily be avoided by the user.

As mentioned above, the dispenser 101 of the present invention suitably should not dispense substance through the applicator tip 118 while it is within the dispenser 101. As shown in the figures (FIG. 4 for views of internal components), an axial initiating force applied to the deactivated plunger 109 of FIG. 3A will not induce ejection of substance from the applicator 117, even though a similarly applied impulse to activated plunger 109 of FIG. 3B does. This apparent discrepancy is a result of the plunger spring 123. For a dispenser 101 depicted by the figures, the plunger spring 123 is suitably stiffer than retraction spring 119. Therefore, when the two springs oppose each other, the retraction spring 119 compresses sufficiently to achieve the configuration of FIG. 3B before the plunger spring 123 compresses enough to accomplish expulsion of substance through applicator 117. Once locked into an open configuration of FIG. 3B, the plunger spring 123 opposes depression of the plunger 109 along the plunger track 136 to the open and dispensing position in FIG. 3C. Because there are normally no means for locking the plunger spring 123 into a fully compressed state, the plunger spring 123 usually expands after a plunger 109 depressing impulse, which thereby causes reversion of the fully depressed plunger 109 of FIG. 3C to the partially depressed plunger 109 of FIG. 3B. In an alternative embodiment, arm 116 prevents the expulsion of substance while the applicator tip 118 is concealed within dispenser 101. In this case, the distal end of contracted arm 116 within the body 103, abuts the internally housed edge of plunger 109, thereby preventing compression of plunger spring 123 while the dispenser is in the deactivated state illustrated by FIG. 1. By way of the plunger 109 interaction with arm 116, the plunger 109 depression drives the reservoir body to the anterior of the body cavity 106, opens cap 105, and exposes the applicator tip 118 through anterior opening 102. Once the dispenser 101 attains an open configuration illustrated by FIG. 3A, arm 116 extends away from the internal edge of plunger 109 to interact with ledge 112 thereby locking the dispenser in position. Since the arm 116 no longer interacts with plunger 109, plunger spring 123 may be compressed by further plunger 109 depression and substance dispensed from the exposed applicator tip 118.

The dispenser 101 of the present application has a suitably retractable applicator 117 (which usually features an applicator shaft 115 and applicator tip 118) which may electively be re-concealed after use. Upon completion of desired dispensing, the lever 107 as an activated reversion means may be selectively acted upon to invoke reversion to a closed configuration. FIGS. 3A and 3B provide an illustration of this type of reversion. The activated lever 107 of FIG. 3B is accessible at slit 111. FIG. 3B shows the arm 116 extended to interact with ledge 112 just below orifice 111 to lock dispenser 101 in the open configuration. When the lever 107 of FIG. 3B is deflected through slit 111, the lever 107 causes arm 116 to contract and dispenser 101 reverts to its FIG. 3A configuration. After arm 116 contracts, the retraction spring 119 expands, the applicator 117 (which usually features an applicator shaft 115 and applicator tip 118) enters the body 103 through anterior opening 102, the shoot press moves toward the anterior of the body 103 which draws the cap shoots 110 through the cap housing 122 into the body hollow 106, the cap 105 is suitably guided by flexor 113 to cap housing 122, reservoir body 127 and arm 116 move from their anterior position to their posterior positions, the plunger 109 and its internal components extend fully from the dispenser body 103, and finally the cap 105 seals anterior opening 102.

FIG. 4 is an exploded view of the dispenser 101 depicted in the figures. FIG. 4 is also an inventory of parts, and a construction diagram for the dispenser 101 of FIGS. 1, 2A, 2B, 3A, 3B and 3C. The components generally fit together by following the dashed line from the top left to the bottom right of the FIG. 4. More specifically, after substance has been loaded into the chamber 128, the piston 125 couples with plunger shaft 121 (AA to AA') and together the piston 125 and plunger shaft 121 merge approximately coaxially with the reservoir body 127 through its anterior, such that the piston 125 defines an anterior, inner wall of chamber 128 and plunger shaft 121 is extended out of the reservoir body 127 rear. The exposed end of the plunger shaft 121 suitably inserts coaxially into the resister 126 (BB to BB'), and coaxially into the driver 129 (CC to CC') by way of cooperating grooves 135 at the plunger shaft 121 and driver 129 interface. The resister 126 and driver are suitably positioned at the reservoir body anterior in the resistor path 145 and driver path 131 respectively. The driver 129 is positioned so that its posterior portion inserts coaxially into the female, anterior end of the crank 130 (DD to DD'), and so the driver teeth 133 are subject to interaction with crank teeth 134 (EE to EE'). Any portion of the plunger shaft 121 which remains exposed from the driver 129 will also suitably be inserted into the crank 130 with the driver 129 posterior. The crank 130 posterior is operationally configured for insert into plunger spring 123 without obstructing the crank path 132. In the present embodiment, a male member 146 having a reduced diameter relative to the main portion of the crank 130, protrudes from the crank 130 posterior which member 146 may then be inserted into anterior of the plunger spring 123 (FF to FF'). The difference in diameter between the member 146 and the main portion of the crank 130 prevents the plunger spring 123 from obstructing the crank path 132. The posterior of the plunger spring 123 is thereafter inserted into the crank housing 140 cavity (GG to GG') wherein crank guide 141 is positioned for unobstructedly traversing/reversing crank path 132 (HH to HH') as discussed above. Thereafter all the aforementioned components beginning with the reservoir body 127 and ending with the crank housing 140 are positioned within the plunger cavity 108 so that the grip 144 and channel 143 align with the appropriate cooperating locations within the plunger cavity 108, and so the reservoir body 127 interacts with the plunger 109 at plunger track 136 (II to II'). The arm 116 may then be attached to the anterior of the reservoir body 127 (JJ to JJ'). The applicator shaft 115 is usually coaxially inserted through the shoot press 124 so that the shoot press 124 is adjacent to the reservoir body 127 anterior (KK to KK'). The retraction spring 119 may then be placed around the applicator shaft 115 (LL to LL') but into the shoot press 124 (MM to MM'). The posterior of spring stop 120 inserts masculinely into spring 119 (NN to NN') but femininely receives the applicator shaft 115 (OO to OO') and usually abuts the shoot press 124. The applicator tip 118 may then be positioned at the distal end of applicator shaft 115 (PP to PP'). The applicator tip 118 may then be positioned/inserted at the anterior portion of cap housing 122 (QQ to QQ'). The cap shoots 110 are fastened to shoot press 124 (RR to RR') and passed through the spring stop 120 at notch 147 and the cap housing 122 (SS to SS'), after which they are fastened to cap 105 as shown in FIG. 4. The cap 105 may then be situated at the cap housing 122 (TT to TT'). Finally, all afore mentioned components, beginning with the plunger 109 and ending with the cap housing 122, are inserted into the anterior opening of the dispenser body 103 until the plunger 109 is prevented from further extending out from the anterior opening 104 (UU to UU') by the nub 138, and the cap housing 122 is forced into the body 103 anterior (VV to VV').

After contained substance stock is sufficiently diminished by dispenser 101 use, the dispenser 101 may be disposed of or replenished with substance. If replenishment of substance is desired, usually the internal components are reset accordingly and the chamber re-stocked with substance. This application contemplates that a dispenser 101, and reservoir, may be either disposable or refillable.

The figures depict the dispenser 101 with a rigid but hollow tubular body 103, a rigid but hollow cylindrical plunger 109, and other components of various shapes and relative sizes. However, the body 103 and plunger 103 need not be tubular or cylindrical but may be any shape seen fit by a person skilled in the applicable art. In addition to cylinders, other shapes, including, but not limited to squared, polygonal shapes, may be employed. Similarly, the various components shape and relative size may also be so modified. For example, a dispenser 101 depicted by the figures may have the general appearance of a right cylinder, but the general appearance may also be that of any three-dimensional object.

The materials suitable for forming the dispenser 101 and its components will vary depending on the physical properties of the substance contained, and the nature of the expected dispenser 101 use. The proper combination of materials for contained substance will be readily apparent to those skilled in the art. Keeping that in mind, the components of a dispenser 101 may be formed using a variety of preferable materials, including but not limited to metals, alloys, composites, woods, and a variety of hard plastics including but not limited to high-density polyethylene, polypropylenes, PVC, and other materials that will be appreciated by those skilled in the art.

An alternate embodiment of the present application is the dispenser 201. Dispenser 201 is functionally similar to the previous embodiment 101 contemplated by FIGS. 1-6, with variations as set forth below. More specifically, aspects and components for dispenser 201 are similar to the corresponding ones of the earlier described preferred embodiment 101.

Figures 7, 8A, 8B:
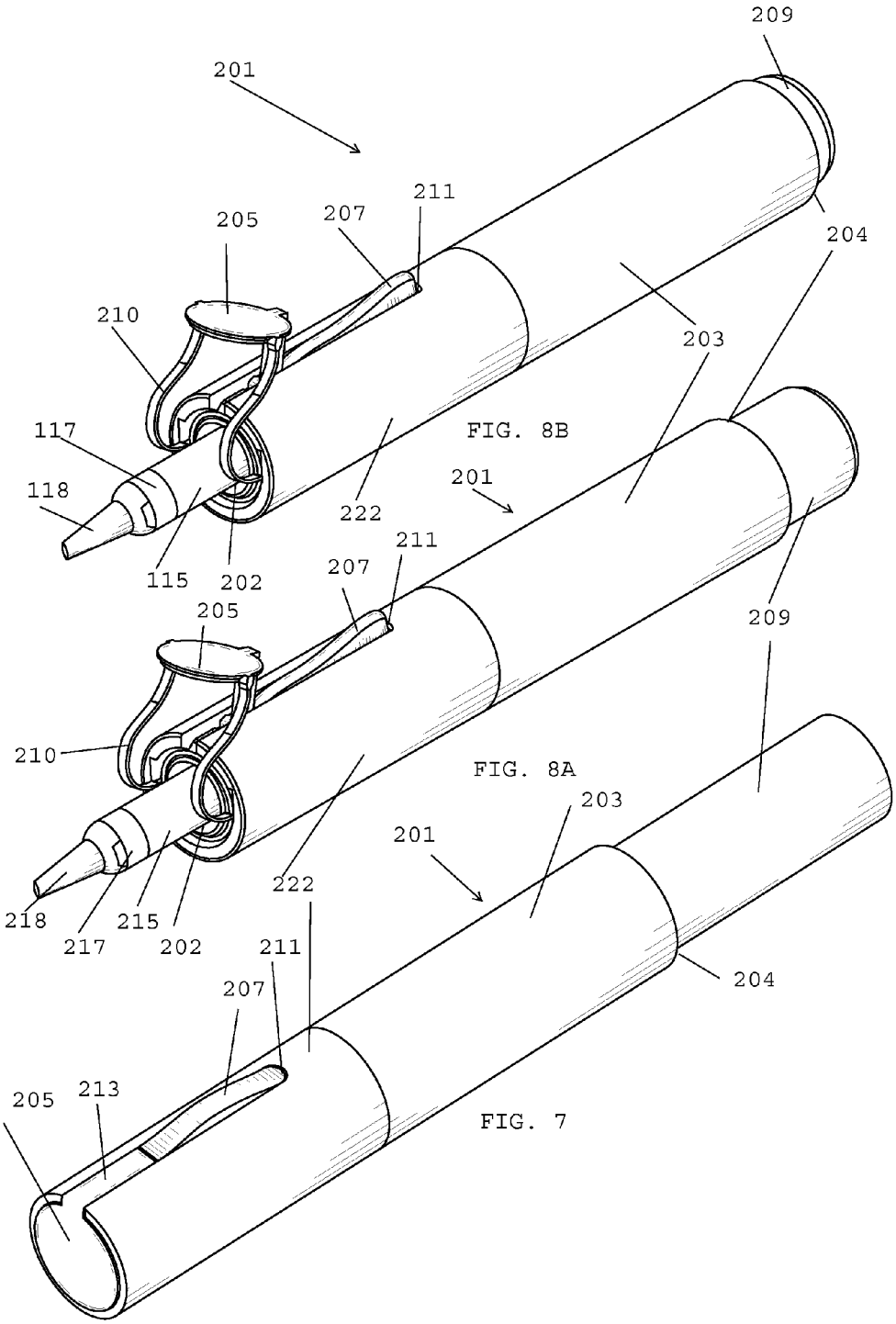
FIG. 7 is a perspective view of a second embodiment of a dispenser 201 in a closed configuration.
FIG. 8A is a perspective view of the dispenser 201 in an open configuration.
FIG. 8B is a perspective view of the dispenser 201 in an open and dispensing configuration.

FIG. 7 depicts a dispenser 201 in a closed configuration. Similar to FIG. 1, FIG. 7 shows a dispenser 201 featuring a body 203 and a slit 211 coupled to a cap housing 222 with a lever 207 at the body 203 anterior, which lever 207 suitably defines an excrescence on the dispenser 201. FIG. 7 also shows the anterior of the dispenser 201 suitably occupied by a cap 205 and cap housing 222 preferably for variably sealing the anterior opening 202 of the dispenser 201. The posterior of the body 203 is suitably occupied by a plunger 209 that typically coaxially merges into (or with) the body 203 by way of the posterior opening 204. Similar to the corresponding components of the dispenser 101 of FIG. 1, in FIG. 7, the plunger 209 represents a deactivated trigger and the anterior opening 202 represents an exit location for the applicator 217. As detailed below, the lever 207 is an inactive reversion means, meaning that it may function to release the applicator 217 from a fixed extended position, allowing it to be selectively retracted by the user into the dispenser 201. Also detailed below, in FIG. 7 the cap housing 222, body 203, and plunger 209 have various internally concealed components.

FIG. 8A typifies a dispenser 201 in an open configuration. The figure illustrates a cap 205 held open and away from anterior opening 202 by a pair of rigid, yet flexible, cap shoots 210 and a stem 213. Similar to FIG. 2A, FIG. 8A also depicts the protrusion of an applicator 217 through the exposed anterior opening 202. An activated lever 207 is accessible at slit 211, and a partially depressed plunger 209 extends from the posterior opening 204. In FIG. 8A the anterior opening 202 is the exit location for applicator 217. As detailed further below, the lever 207 is suitably an activated reversion means. Also detailed below, in FIG. 8A the cap housing 222, body 203 and plunger 209 have various internal components.

The dispenser 201 of the present application has a suitably retractable applicator 217 which may be electively exposed for applicator tip 218 use. Similar to the earlier preferred embodiment 2, elective transition from a closed to an open configuration is usually achieved through application of an initiating force which suitably activates the plunger 209 as a trigger, exposes anterior opening 202, and protrudes the applicator 217 from the dispenser 201. In most instances, the acting force on the plunger 209 will be generated by the user manually, for instance by a thumb or finger. The dispenser 201 typically has a natural tendency to revert from an open to a closed configuration. As discussed further herein, during transition from closed to open configurations, this tendency is normally continuously opposed to applicator 217 protrusion and plunger 209 activation. However, once the plunger 209 has been activated, the applicator 217 is suitably locked in external position and natural reversion to a closed configuration is prevented. Also discussed further herein, once the dispenser 201 is suitably locked into an open configuration, the lever 207 suitably becomes an activated reversion means which may electively be acted upon to release the lock, thereby enabling the aforementioned natural tendency to actuate reversion to a closed configuration. FIGS. 7 and 8A taken together may help visualize this transition. Referring to these two figures, when an external axial force is applied to the butt of the plunger 209 in FIG. 7, such force depresses the plunger 209, extrudes cap shoots 210 from cap housing 222, releases the cap 205 along flexor 213, and projects applicator 217 from the anterior opening 202. Once the force moves the plunger 209 to its partially depressed position in FIG. 8A, plunger 209 and lever 207 are activated and the configuration is usually locked in place. At this point, reversion to the closed state of FIG. 7 normally can only be attained through interaction with lever 207. See the discussion below for more details.

FIG. 8B depicts a dispenser 201 in an open and dispensing configuration. The FIG. 8B configuration is suitably necessary for expulsion of contained substance through an exposed applicator tip 218. As seen in the figure, a dispenser 201 in such an open and dispensing configuration has components in roughly the same relative positions as that of FIG. 8A, but the plunger 209 is suitably depressed fully toward the body 203. In other words, the depressed and active plunger 209 may be typically used as an active trigger to forcibly eject cosmetic substance from an applicator tip 218 of the dispenser 201.

Transition from an open (FIG. 8A) to an open and dispensing (FIG. 8B) configuration is usually accompanied by a motive force placed upon the contained substance. The motive force may preferably be caused by the plunger 209 being fully depressed and active. A fully depressed and active plunger 209 typically results from axial impulse on the end of the activated plunger 209, as shown in FIG. 8A. As discussed in more detail below, this impulse preferably induces metered dispensing of a contained substance from the exposed applicator tip 218. Applicator 217 may feature at least one, or a plurality of orifices through which substance may be expelled. Dissipation of the aforementioned impulse results in reversion of the plunger 209 from fully to partially depressed and suitably ends dispensing of substance until a new impulse is triggered. Usually there is no mechanism to lock the dispenser in an open and dispensing configuration. FIGS. 8A and 8B together may help visualize this process. Referring to these two figures, when an external axial impulse is applied to the butt of the plunger 209 of the dispenser 201 in FIG. 8A, this impulse usually fully depresses the plunger 209 to its position in FIG. 8B which induces metered expulsion of a contained substance from applicator tip 218. Upon dissipation of the axial impulse, the fully depressed plunger 209 preferably automatically returns to its position in FIG. 8A. A typical use cycle would entail impulsive depression of the plunger 209 from its partially depressed position in FIG. 8A to a fully depressed position of FIG. 8B, followed by reversion to its partially depressed position in FIG. 8A. Normally, the cosmetic dispensing feature of dispenser 201 is accomplished by the plunger 209 being cycled repeatedly to cause sufficient accumulation of contained substance at the applicator tip 218, where a user would then apply the substance to the lips, eyes, face, or the like.

Still referring to FIGS. 8A and 8B, the specifics of the applicator 217 (usually including the applicator shaft 215 and applicator tip 218) depend on the type of substance and the nature of the dispenser 201 purpose. In the accompanying figures, the applicator tip 218 is a hollow truncated cylinder with an angled cylindrical section as the applicator tip 218 surface, as one might see in a lip gloss applicator. In some instances, however, the applicator tip 218 may just be an orifice or other type of opening through which a substance may be discharged. In another instance, the applicator tip 218 may be a membrane through which substance may be expelled. In yet another instance, the applicator tip 218 may be some type of rigid member to which expelled substances may adhere while awaiting application (e.g., a brush disposed over an orifice whereby the brush bristles collect substance expelled thereon).

Figure 8C:
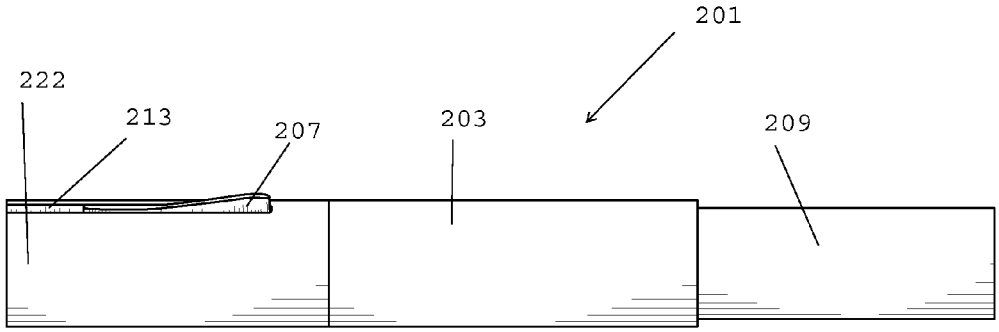
FIG. 8C is a side view of the closed dispenser of FIG. 7
Figure 8D:
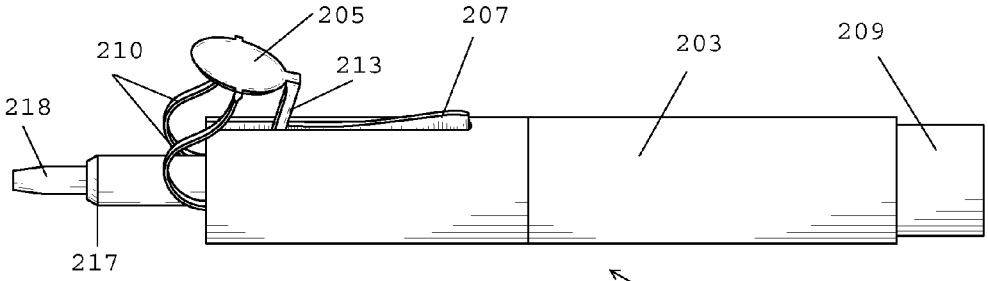
FIG. 8D is a side view of the open dispenser of FIG. 8A.
Figure 8E:
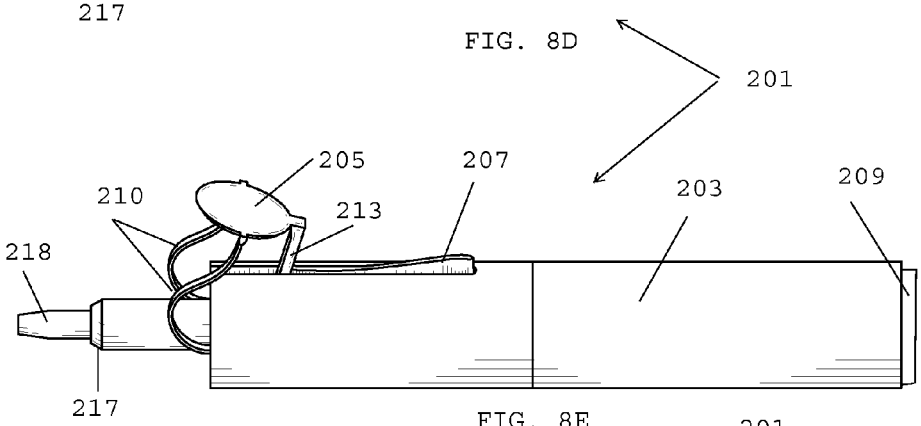
FIG. 8E is a side view of the open and dispensing dispenser of FIG. 8B.

FIGS. 8C, 8D, and 8E are side views of the dispenser 201 which respectively correspond to the closed, open, and open and dispensing configurations of FIGS. 7, 8A and 8B.

Figure 9:
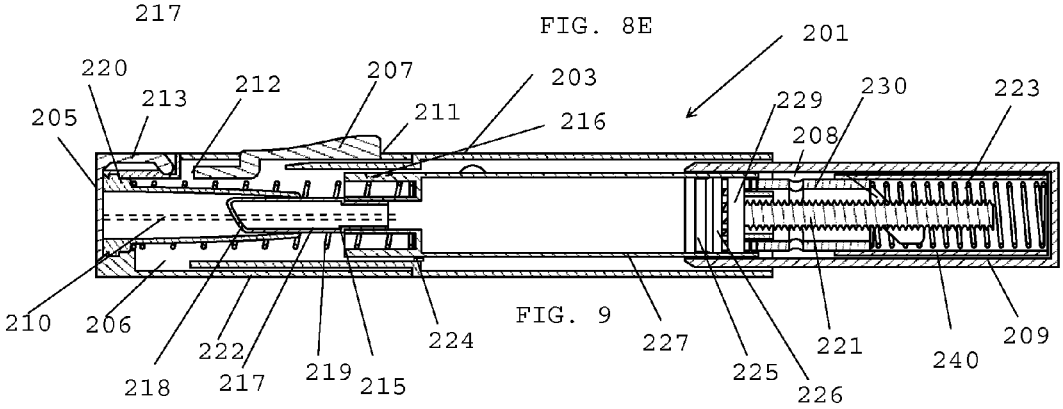
FIG. 9 is cross section of the dispenser of FIG. 7.
Figure 10:
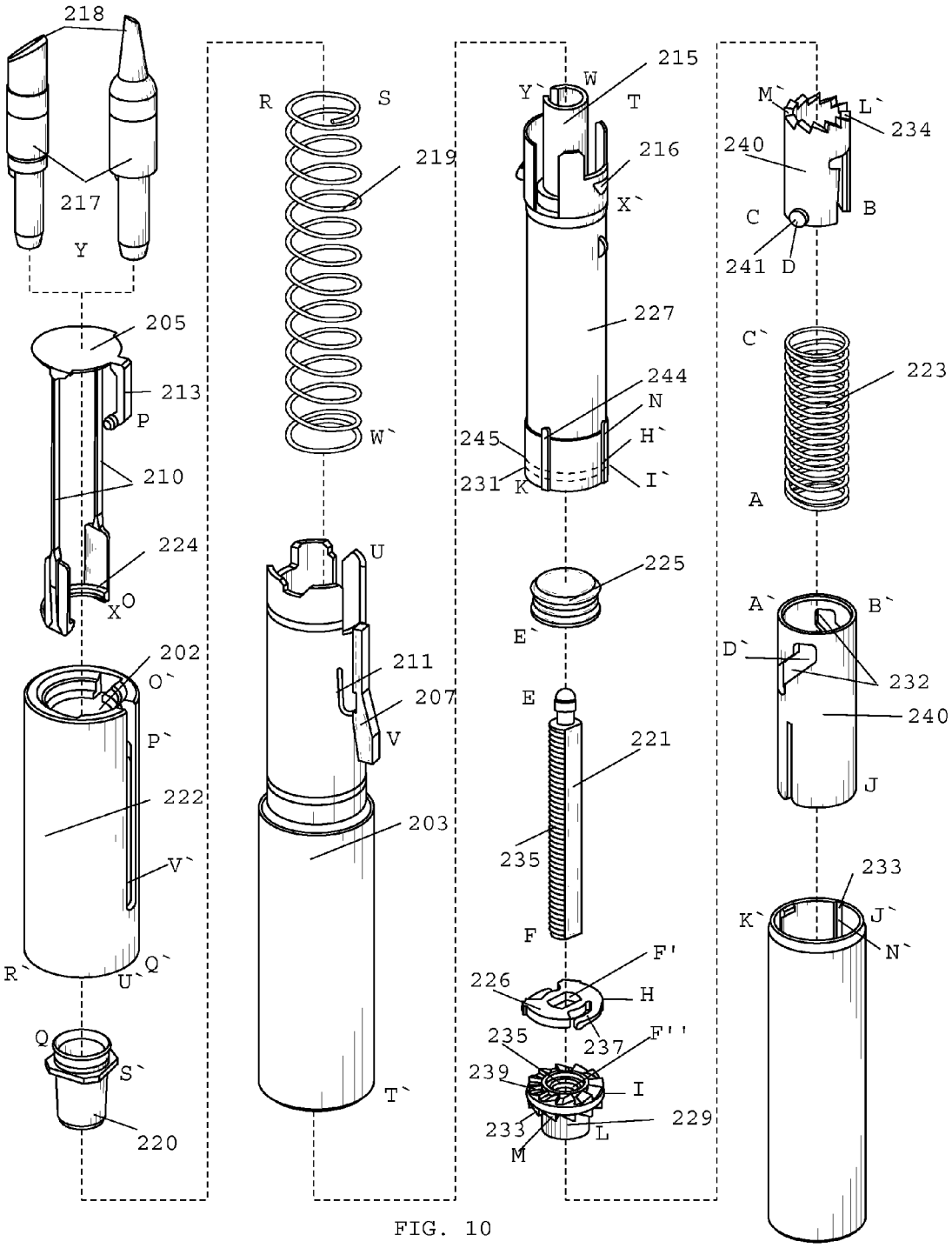
FIG. 10 is an exploded view of the dispenser 201 of FIG. 7

FIG. 9 is a longitudinal cross-section of the dispenser 201 of FIGS. 7 and 8C (since the figure is a cross-section, the specific features of the depicted components are best viewed by reference to FIG. 10 which is an exploded view of the dispenser). The figure shows a dispenser 201 with a closed cap 205 and body hollow 206 which houses the applicator 217 including the applicator shaft 215 and applicator tip 218, the retraction spring 219, the cap shoots 210, the shoot press 224, edge 212, a movable reservoir body 227 (which contains the piston 225, and part of the plunger shaft 221), resistor 226, drive gear 229, and crank 230. The figure also shows a dispenser with a plunger cavity 208 that houses the plunger spring 223, the crank housing 240, and most of the plunger shaft 221, drive gear 229 and crank 230. In FIG. 9 the plunger 209 is fully extended away from the body 203 and the internal components of the body hollow 206 are toward the body 203 posterior. The reservoir body 227 and its chamber 228 are an enclosure configured to contain cosmetic substances, which are usually fluid or powder in nature. Typical substances include, but are not limited to, lipstick, mascara, lip gloss, blemish remover, concealers, eyeliners, and the like as will be appreciated by those skilled in the industry. The applicator shaft 215 suitably defines an avenue or channel between the applicator tip 218 and the chamber 228 containing substance. In other words, the applicator shaft 215 and chamber 228 are suitably in fluid connection with one another.

When the dispenser 201 is an open configuration as depicted in FIG. 8A, the cap 205 may suitably be held open and away from anterior opening 202 by a pair of rigid, yet flexible, cap shoots 210 and a stem 213 pivotably mounted to the cap housing 222. Further, the applicator 217 (which usually includes applicator tip 218 and applicator shaft 215) may preferably protrude through the exposed anterior opening 202 while the dispenser 201 is open. Referring to FIG. 9 in view of FIG. 10 and the corresponding components of the dispenser 201 in FIG. 3A, the body hollow 206 of an open dispenser 201 houses the following components: the retraction spring 219 which may be compressed against the spring stop 220; the shoot press 224 which may push, as the reservoir 227 shifts to the anterior of the dispenser 201 the cap shoots 210 through the cap housing 222; the slot 216 extended to the edge 212; and the reservoir body 227, which is locked in its position and which contains the piston 225 and part of the plunger shaft 221, resistor 226, drive gear 229, and crank 230. Still referring to FIG. 9 in view of FIGS. 3B and 10, an open dispenser 201 features a plunger cavity 208 that houses the plunger spring 223, idle plunger shaft 221, resistor 226, drive gear 229, and crank 230. In the open configuration, the plunger 209 is suitably activated and more depressed within the body 203 than the deactivated plunger 209 of FIG. 9 whereby the internal components of the body 203 hollow 206 are more toward the dispenser 201 anterior in the same general manner as depicted in FIG. 3B.

When the dispenser 201 is in the open and dispensing configuration of FIG. 8B, the dispenser 201 components are similarly situated to the open configuration of FIG. 8A except that plunger 209 may be fully depressed to within the dispenser 201. Referring now to FIG. 9 in view of FIGS. 3C and 10, the open and dispensing dispenser 201 preferably features a plunger cavity 208 which suitably houses a compressed plunger spring 223, a working plunger shaft 221, resistor 226, piston 225, drive gear 229 and crank 230.

As mentioned above, a dispenser 201 transition from a closed to open configuration is opposed by a natural tendency to remain in and revert to a closed configuration. FIGS. 7, 8A and 9 (and FIG. 10 for views of internal components) provide an illustration of such a natural tendency. These figures show a dispenser 201 with a retraction spring 219. FIGS. 1 and 9 depict the retraction spring 219 while the dispenser 201 is in a closed configuration. Transitioning from the dispenser 201 of FIGS. 7 and 9 to that shown in FIG. 8A is accomplished by depressing the plunger 209 to within the dispenser 201 in similar manner disclosed above with respect to FIGS. 3A and 3B whereby the retraction spring 219 may compress against the spring stop 220 and reservoir body 227 while the cap press 224 suitably pushes the cap 205 open via the cap presses 210. More specifically, plunger 209 depression suitably may accomplish at least the following: (1) moves the reservoir body 227, shoot press 224, and slot 216 toward the anterior; (2) extrudes the cap shoots 210 through cap housing 222 to pivotably open the cap 205 around the stem 213; (3) drives the applicator 217 protrusion; and, (4) suitably compresses the spring 219 between the spring stop 220 and the moving reservoir body 227. Thus, the force of compressed retraction spring 219 may be constantly opposed to plunger 209 depression, applicator 217 protrusion, and an open dispenser 201 configuration. The transition from a closed dispenser 201 of FIGS. 7 and 9 to an open dispenser 201 of FIG. 8A is accomplished when the slot 216 interfaces with the edge 212 whereby the dispenser 201 is locked open. In the open configuration, the plunger 209 is suitably activated.

Though the figures depict retraction spring 219 as the natural tendency, an internal compression spring is not the only means for inducing the aforementioned natural tendency. Such natural tendency may be invoked internally or externally through the use of magnets, elastics, rubbers, manual or any other attractive or repulsive force.

As mentioned above, until dispenser 201 is locked into the open configuration, the natural tendency will suitably invoke reversion to a closed configuration. Similar to the earlier disclosed embodiment 101, the dispenser 201 of the present application typically uses a suitable latching means to lock the open configuration when the applicator 217 has been protruded sufficiently from the anterior opening 202. The latching means may remove the natural tendency or suitably counteract its force. Similar to FIGS. 3A and 3B (in view of FIG. 4), FIG. 9 (in view of FIG. 10) illustrates a latching means. FIG. 9 depicts a slot 216 set into the reservoir body 227 for interfacing with an edge 212 notched within the body 203 preferably below the lever 207 (note: the nub next to the slot 216 is a fulcrum point for the lever 207). Application of an axial initiating force at the plunger 109 butt, depresses the deactivated plunger 209 of FIG. 9, and moves the slot 216 toward edge 212 below lever 207 and slit 211. Similar to the earlier embodiment, the nub interfaces with the edge 212 such that compressed retraction spring 219 cannot expand to force the dispenser 201 to a closed configuration.

Though the figures depict a slot 216 and edge 212 as the latching mechanism for dispenser 201, there are many other suitable latching means. This latching means might take the form of a hook, lever, constriction, latch, adhesive, friction, and by other means that would be appreciated by those skilled in the art.

As alluded to above, the plunger 209 becomes an activated trigger in the open configuration since further depression accomplishes expulsion of contained substance from the exposed applicator 217 at the applicator tip 218. To prevent undesired and unintentional internal ejection of contained substance at the applicator tip 218, the plunger 209 is not used to eject substance until dispenser 201 is in the open configuration. As mentioned above, the deactivated plunger 209 of FIG. 9 may be depressed by an initiating force until slot 216 meets edge 212 to lock the dispenser in its FIG. 8A configuration. Beginning at FIG. 9, an initiating force applied to the butt of deactivated plunger 209 moves at least one of the reservoir body 227, shoot press 224, and slot 216 from a posterior position to an anterior position within the dispenser. During depression, the retraction spring 219 suitably compresses against spring stop 220 and reservoir body 227, the cap shoots 210 preferably extrude out of the cap housing 222, the cap shoots 210 force open the cap 205 while the stem 213 pivotably guides the cap 205 away from anterior opening 202, and the applicator 217 (which usually includes applicator shaft 215 and applicator tip 218) protrudes from the dispenser 201 through the anterior opening 202 (see FIG. 8A). When locked in this open configuration, the plunger 209 is activated because further plunger 209 depression induces substance movement along applicator shaft 215 culminating with ejection through the applicator 217, suitably by way of the applicator tip 218.

A lever 207 becomes an activated reversion switch when action upon it results in reversion from an open to closed configuration. A lever 207 as a reversion switch is a suitable means for unlocking the open configuration. FIGS. 8A and 9 (and FIG. 10 for views of the internal components) illustrate the activation of a lever 207 as a reversion switch. In FIG. 8A, slot 216 interacts with ledge 212 below the slit 211 to prevent retraction spring 219 from expanding from its compressed state. While slot 216 is interacting with edge 212, lever 207 deflection is required to dissociate the slot 216 from the edge 212 and thereby effectuate reversion of dispenser 201 to a closed configuration. In the open configuration, the lever 207 of FIG. 8B is an activated reversion switch because acting thereon shifts the edge 212 away from the slot 216, and allows retraction spring 219 to push the exposed applicator 217 (which usually features an applicator shaft 215 and an applicator tip 218) back within the body to the FIG. 9 configuration. The lever 207 in FIG. 9 is inactive because acting on it does not result in reversion. Finally, as mentioned above, lever 207 suitably defines an excrescence on the dispenser 201 in order that lever 207 may be more readily identified whether by sight or feel. However, the degree or extent of desirable excrescence will vary and change depending on desired dispenser 201 use and in some instances a lever 207 may be flush with the dispenser 201 surface and not define an excrescence at all. Such details will be apparent to those skilled in the art. Though the figures depict the lever 207 in association with slit 211 as a reversion switch, anything that releases the dispenser 201 latching means may be used as a reversion switch.

Another feature of the dispenser 201 is the cap 205 which, in conjunction with an elastomeric spring stop 220 and the applicator shaft 215, electively seals or unseals the anterior opening 202, typically by way of a substantially air or water tight pocket. FIGS. 7, 8A, 8B and 9 (and FIG. 10 for views of the internal components) provide an illustration of the cap 205 in operation. While dispenser 201 is in a closed configuration like that of FIGS. 7 and 9, the cap 205 suitably seals the anterior opening 202 of the dispenser 201 as follows: the retraction spring 219 may be fully extended and thereby preferably forces against the reservoir body 227 to press the spring stop against the cap housing 222; the shoot press 224 suitably pulls the cap shoots 210 taut, which tension usually interlocks the cap 205 with the cap housing 222 and secures the cap 205 over the anterior opening against the anterior of spring stop 220; the tension on the cap shoots 210 between the shoot press 224 and the cap 205 suitably squeezes the spring stop 220 between the cap 205 and the cap housing 222 thereby forcing deformation of the elastomeric spring stop 220 until the anterior opening 202 is substantially air or water tight; and finally, at the posterior of the spring stop 220, the applicator shaft 215, which is coaxial to the spring stop 220 and which has an increasing diameter toward the applicator 217, forces deformation of the posterior of the spring stop 220 by way of its increasing diameter relative to the diameter of the spring stop 220 (see FIG. 8A). Accordingly, a substantially air or water tight pocket is created between the cap 205, the spring stop 220 and the applicator shaft 215. Further, the dispenser 201, under such a seal, can withstand internal pressures associated with the containment of volatile fluids. Other sealing means preferably may be placed throughout the dispenser 201 to effectuate an optional air or water tight dispenser 201. As illustrated by 8A and 9, to unseal the cap 205, plunger depression moves the reservoir body 227 and shoot press 224 internally toward the anterior opening 202, the shoot press 224 preferably forces the cap shoots 210 through the cap housing 222, and the cap 205 is forced off of the anterior opening 202 by the cap shoots 210 and drawn away by the pivoting stem 213.

Also, as the tip 218 is exposed from anterior opening 202, the decreasing diameter of the applicator shaft 215 relative to the posterior of the spring stop 220 permits the elastomeric spring stop 220 to return to equilibrium. A substantially air or water tight pocket at the anterior opening is useful to prevent contamination, corruption, or dehydration/drying of the tip 218 and contained substance. Additionally, attached to the distal end of the stem 213 is a pivoting mechanism which interacts with cap housing 222 to extend the useful life the seal. This feature typically allows the cap 205 to come down evenly on the seal surface of spring stop 220 without applying to much pressure to one side of the elastomeric spring stop 220 and possibly deforming it over time.

The dispenser 201 of the present application normally ejects a substance through the exposed applicator 217 at the applicator tip 218 after an impulse has sufficiently depressed a plunger 209 and induced movement of a contained substance along an applicator shaft 215 between the applicator tip 218 and the chamber 228. Movement of said contained substance along the applicator shaft 215 may be realized by a piston, pump, suction, expansion, compression or otherwise as will be appreciated by those skilled in the art. As described below, FIGS. 8A, 8B and 9 (and FIG. 10 for views of the internal components) illustrate a typical dispensing process for the dispenser 201.

In response to an axial impulse that is suitably applied to the butt of the activated plunger 209 shown in FIG. 8A, the plunger 209 further depresses until it is fully depressed as depicted by FIG. 8B, after which the plunger 209 reverts to its FIG. 8A position. During this complete depression and reversion of the plunger 209, the crank 230 as seen in FIGS. 9 and 10 changes into a working crank 230 as follows: (1) the crank housing 240 and associated crank guide 241 suitably advance toward the reservoir body 227; (2) the crank guide 241 (as seen in FIG. 10) traverses crank path 232 which axially torques the crank 230 relative to the reservoir body 227 because grip 244 interacts with channel 243 to prevent the crank housing 240 and associated crank guide 241 from axially rotating relative to the reservoir body 227; (3) the crank housing 240 and associated crank guide 241 suitably retreat away from the reservoir body 227; and, (4) the crank guide 241 reverses crank path 232 which axially torques the crank 230 in the opposite direction relative to the reservoir body 227 because grip 244 and channel 243 prevent the crank housing 240 and associated crank guide 241 from axially rotating relative to the reservoir body 227.

At the immediate anterior of the reservoir body 227 is housed the driver 229 and resistor 226 which are suitably held in longitudinal position relative to the reservoir body 227 by the drive path 231 and resistor path 245 respectively. The resistor 126 is fixed axially (may not traverse resistor path 245), while the driver may rotate axially (may traverse drive path 231). In other words, the driver 229, but not resistor 226, may rotate axially relative to the reservoir body 227, while both suitably do not move longitudinally from their position at the anterior of the reservoir body 227. The driver 229 has driver teeth 233 on its lower side which interlock with the crank teeth 234 while the crank guide 241 is traversing crank path 232 during activated plunger 209 depression. The driver teeth 233 and crank teeth 234 functionally disengage while the crank guide 241 is reversing crank path 232 during dispenser reversion from an open and dispensing configuration (FIG. 8B) to an open configuration (FIG. 8A). A working crank 230 torques the driver 229 relative to the reservoir body 227 and resistor 226 as the crank guide 241 traverses crank path 232 because the crank teeth 234 and driver teeth 233 are suitably interlocked, thereby inducing driver 229 rotation simultaneously and to the same degree as the crank 230. Though the crank 230 rotates in the opposite direction as the crank guide 241 reverses crank path 232, the driver 229 does not, because usually the crank teeth 234 and driver teeth 233 are functionally disengaged and because of a resister 226. The resister 226 sits adjacent to the driver 129 in resistor path 245. The resistor 226 typically features resister digits 237 that interact with digit grips 239 on the facing surface of the driver 229 to allow the driver 229 to rotate simultaneously with the crank 230 around driver path 231 as crank guide 231 traverses crank path 232, but to disallow driver 229 rotation in the opposite direction as crank guide reverses crank path 232. Consequently, as dispenser 201 reverts to its open configuration, crank teeth 234 and driver teeth 233 may suitably slide past each other and reset for subsequent depression of the plunger 209 and associated driver 229 rotation. Though the figures depict driver teeth 233 and crank teeth 234 whose profiles are cooperating triangles, those skilled in the art will know various other mechanisms for accomplishing the same task. Though the resistor 226 features digits 237 which are bendable appendages which interact with grips 239 having a profile of a triangle, those skilled in the art will know various other mechanisms for accomplishing the same task.

A rotating driver 229 is a working driver 229 because as it rotates, cooperating grooves 235 on the driver 229 and plunger shaft 221 interface, interact to coaxially screw the plunger shaft 221 into the reservoir body 227. Because resister 226 only permits driver 229 rotation in one direction, the plunger shaft 221 is not suitably unscrewed from its position within the reservoir body 227. Each repeated depression of the activated plunger 209 drives the plunger shaft 221 incrementally further into the reservoir body 227. As a result, the piston 225 moves incrementally further into the reservoir body 127. As the plunger shaft 221 is incrementally driven into the reservoir body 227, it suitably pushes the piston 225 from the posterior of the chamber 228 toward the anterior of the reservoir body 227, thereby decreasing the effective volume of the chamber 228, and at the same time, moving the contained substance along the applicator shaft 215 toward expulsion at the applicator tip 218.

As mentioned above, the dispenser 201 of the present invention contemplates that the amount of contained substance induced to move by a single plunger 209 depression may be set by the dispenser 201 manufacturer. The parameters of crank path 232 and the thread pitch of plunger shaft 221 determine the degree of rotation achieved by the crank 230 and therefore, the distance which plunger shaft 221 is screwed and the piston 225 is driven into the reservoir body 227. Knowing this distance, with the geometric configuration of the chamber 228 and the thread pitch of plunger shaft 221, allows the volume of substance expelled at the tip 218 during a single plunger 209 depression to be determined. Metered movement of substance is important because the manufacturer can predict the life of a dispenser 201 and adjust its retail stock accordingly (whether dispenser 201 is disposable or refillable). Moreover, metered movement of substance is important in that globbing, or over accumulation of substance at the tip 218 can more easily be avoided by the user.

As mentioned above, the dispenser 201 of the present invention suitably should not dispense substance through the applicator tip 218 while it is within the dispenser 201. As shown in the figures, an axial initiating force applied to the deactivated plunger 209 of FIG. 9 will not induce ejection of substance from the applicator 217, even though a similarly applied impulse to activated plunger 209 of FIG. 8A does. This apparent discrepancy is a result of the plunger spring 223. For a dispenser 201 depicted by the figures, the plunger spring 223 is suitably stiffer than retraction spring 219. Therefore, when the two springs oppose each other, the retraction spring 219 compresses sufficiently to achieve the configuration of FIG. 8A before the plunger spring 223 compresses enough to accomplish expulsion of substance through applicator 217. Once locked into an open configuration of FIG. 8A, the plunger spring 223 opposes depression of the plunger 209 along the plunger track 236 to the open and dispensing position in FIG. 8B. Because there are normally no means for locking the plunger spring 223 into a fully compressed state, the plunger spring 223 usually expands after a plunger 209 depressing impulse, which thereby causes reversion of the fully depressed plunger 209 of FIG. 8B to the partially depressed plunger 209 of FIG. 8A.

The dispenser 401 of the present application has a suitably retractable applicator 217 (which usually features an applicator shaft 215 and applicator tip 218) which may electively be re-concealed after use. Upon completion of desired dispensing, the lever 207 as an activated reversion means may be selectively acted upon to invoke reversion to a closed configuration. FIGS. 7, 8A, 9, and 10 provide an illustration of this type of reversion. The activated lever 207 of FIG. 8A is accessible at slit 211 (best depicted in FIG. 10). As discussed above, the slot 216 is adapted to extended for interaction with edge 212 just below the lever 207 to lock the dispenser 201 in the open configuration. When the lever 207 of FIG. 8A is deflected through slit 211, the lever 207 causes the edge 212 to disassociate from the slot 216 whereby the dispenser 201 reverts to its FIGS. 7 and 9 configuration. After slot 216 and edge 212 disassociation, the retraction spring 219 expands, the applicator 217 (which usually features an applicator shaft 215 and applicator tip 218) enters the body 203 through anterior opening 202, the shoot press moves toward the anterior of the body 203 which draws the cap shoots 210 through the cap housing 222 into the body hollow 206, the cap 205 is suitably guided by flexor 213 to cap housing 222, reservoir body 227 and slot 216 move from their anterior position to their posterior positions, the plunger 209 and its internal components extend fully from the dispenser body 203, and finally the cap 205 seals anterior opening 202.

FIG. 10 is an exploded view of the dispenser 201 depicted in the figures. FIG. 10 is also an inventory of parts, and a construction diagram for the dispenser 201. The components generally fit together by following the dashed line from the top left to the bottom right of the FIG. 10. More specifically, the dispenser may be assembled according to the following method: (1) the spring 223 may be placed into the crank housing (A to A'); (2) the crank 230 may be inserted into the crank housing 240 (B to B') whereby the spring 223 and crank 240 (C to C') interface while the crank guide 241 occupies the crank path 232 (D to D') and is preferably positioned for unobstructedly traversing/reversing crank path 232 as discussed above; (3) the piston 225 couples with plunger shaft 221 (E to E') and together the piston 225 and plunger shaft 221 merge approximately coaxially with the reservoir body 227 through its anterior, such that the piston 225 defines an anterior, inner wall of chamber 228 and plunger shaft 221 is extended out of the reservoir body 227 rear; (4) the exposed end of the plunger shaft 221 suitably inserts coaxially into the resister 226 (F to F'), and coaxially into the driver 229 (F to F") by way of cooperating grooves 235 at the plunger shaft 221 and driver 229 interface; (5) The resister 226 and driver are suitably positioned at the reservoir body 227 anterior in the resistor path 245 and driver path 231 respectively (H to H'; I to I'); (6) the crank housing 240 may be coaxially inserted into the plunger 209 (J to J'); (7) the reservoir body 227 is coaxially inserted into the plunger 209 (K to K') whereby the driver 229 is positioned so that its posterior portion inserts coaxially into the female, anterior end of the crank 230 (L to L') (it should be noted that any portion of the plunger shaft 221 which remains exposed from the driver 229 and reservoir body 227 will also suitably be inserted into the crank 230 with the driver 229 posterior), whereby the driver teeth 233 are subject to interaction with crank teeth 234 (M to M'), and whereby the grip 244 interacts with channel 243 (N to N'); (8) the cap 205, cap shoot 210, and cap press 224 component may be installed on the cap housing 222 (O to O') whereby the stem 213 is pivotably attached thereto (P to P'); (9) the spring stop 220 may be inserted into the cap housing 222 (Q to Q'); (10) the spring 219 may be provided to the cap housing 222 (R to R') whereby the spring stop 220 and spring 219 interface (S to S') therein; (11) the reservoir body 227, and component assembled thereto, may be inserted into the body 203 (T to T'); (12) the body 203, and components assembled thereto, may be inserted into the cap housing 222 (U to U') whereby the lever 207 extends from the cap housing 222 (V to V'), the reservoir body 227 inserts into and receives the spring 219 (W to W'); and the cap press 224 couples to the reservoir body 227 (X to X'); and, (13) the dispenser 201 may be opened as discussed above, contents deposited into the reservoir body 227, and the applicator 217 may be coupled to applicator shaft 215 (Y to Y') through the exposed anterior opening 202 of the dispenser 201.

After contained substance stock is sufficiently diminished by dispenser 201 use, the dispenser 201 may be disposed of or replenished with substance. If replenishment of substance is desired, usually the internal components are reset accordingly and the chamber re-stocked with substance. This application contemplates that a dispenser 101, and reservoir, may be either disposable or refillable.

The figures depict the dispenser 201 with a rigid but hollow tubular body 203, a rigid but hollow cylindrical plunger 209, and other components of various shapes and relative sizes. However, the body 203 and plunger 203 need not be tubular or cylindrical but may be any shape seen fit by a person skilled in the applicable art. In addition to cylinders, other shapes, including, but not limited to squared, polygonal shapes, may be employed. Similarly, the various components shape and relative size may also be so modified. For example, a dispenser 201 depicted by the figures may have the general appearance of a right cylinder, but the general appearance may also be that of any three-dimensional object.

The materials suitable for forming the dispenser 201 and its components will vary depending on the physical properties of the substance contained, and the nature of the expected dispenser 201 use. The proper combination of materials for contained substance will be readily apparent to those skilled in the art. Keeping that in mind, the components of a dispenser 201 may be formed using a variety of preferable materials, including but not limited to metals, alloys, composites, woods, and a variety of hard plastics including but not limited to high-density polyethylene, polypropylenes, PVC, and other materials that will be appreciated by those skilled in the art. It is further preferable that the body 203 and the reservoir body 227 be transparent whereby the properties (e.g., color) of the deposited substance may be apparent to a user without opening the dispenser 201.

An alternate embodiment of the present application is the dispenser 301. Dispenser 301 is functionally similar to the previous embodiment 301 contemplated by FIGS. 1-10, with variations as set forth below. More specifically, aspects and components for dispenser 301 are similar to the corresponding ones of the earlier described preferred embodiment 101.

Figure 11A:
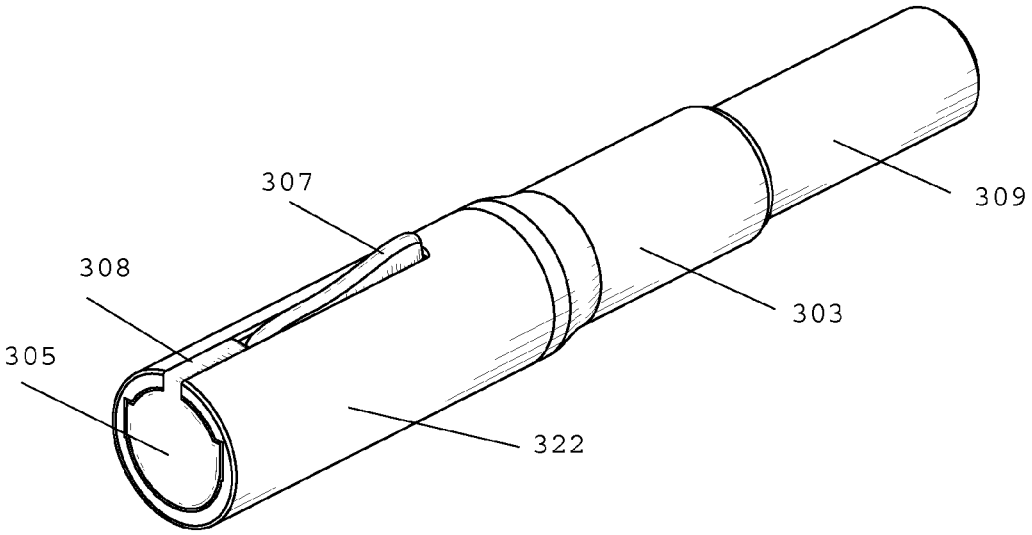
FIG. 11A is a perspective of a third embodiment of a dispenser 301 in a closed configuration.
Figure 11B:
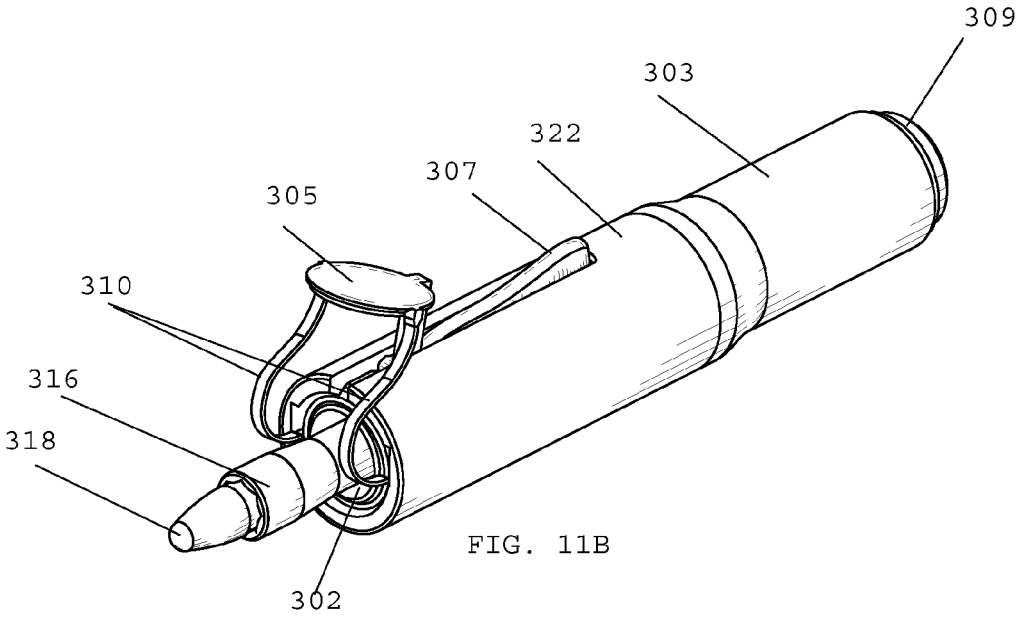
FIG. 11B is a perspective of the dispenser 301 an open configuration.
Figure 12A:
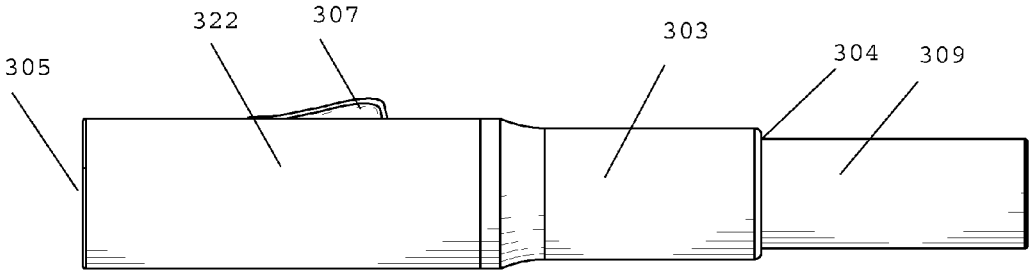
FIG. 12A is a side view of the dispenser 301 of FIG. 11A
Figure 13A:
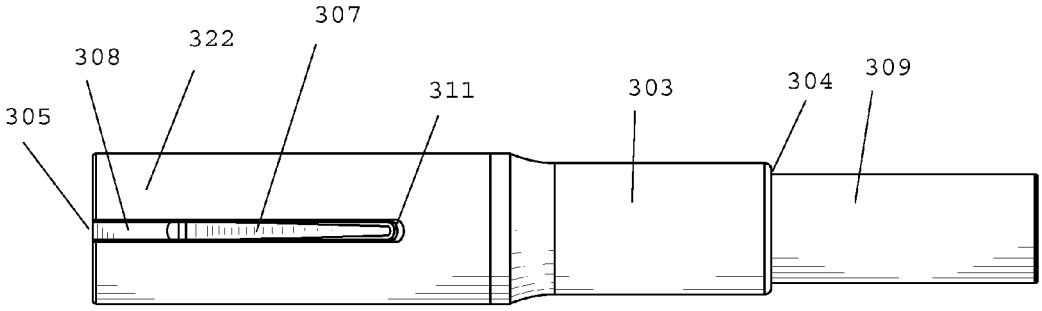
FIG. 13A is a top view of the dispenser 301 of FIG. 11A.
Figure 12B:
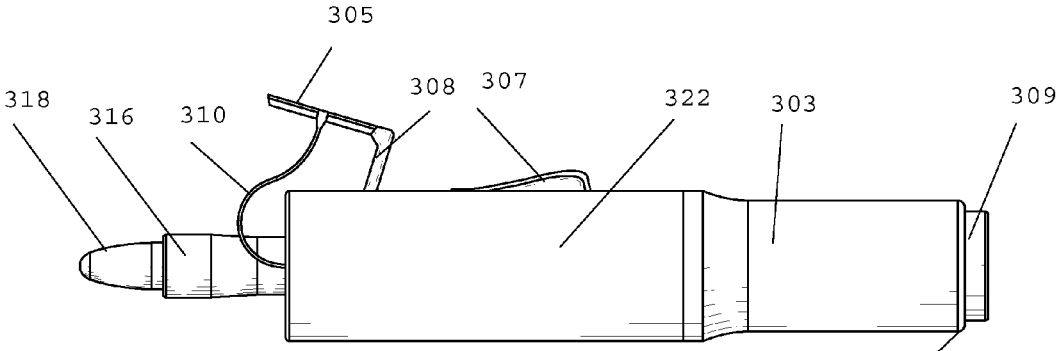
FIG. 12B is a side view of the dispenser 301 of FIG. 11B.
Figure 13B:
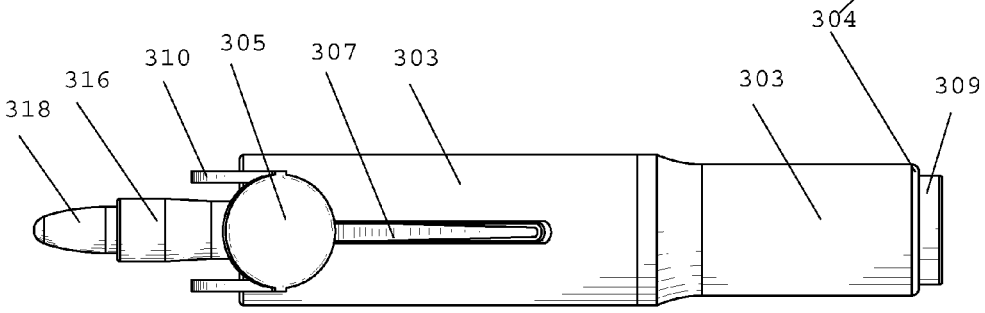
FIG. 13B is a top view of the dispenser 301 of FIG. 11B.

FIG. 11A depicts a dispenser 301 in a closed configuration. FIG. 11B depicts a dispenser 301 in an open configuration. FIGS. 12A, 12B, 13A, and 13B respectively depict a side view of the dispenser 301 of FIG. 11A, a side view of the dispenser 301 of FIG. 11B, a top view of the dispenser 301 of FIG. 11A, and a top view of the dispenser 301 of FIG. 11B. The figures illustrates a dispenser 301 featuring: a cap 305 with a stem 308; a cap housing 322 with an anterior opening 302 and a lever 307 protruding therefrom while adjacent to a slit 311; a body 303 with a posterior opening 304; and a plunger 309. The identified components are assembled into a dispenser 301 that operates in the same general manner as described above in connection with the earlier embodiments. Specifically, an axial force applied to the butt of the plunger 309 preferably opens the cap 305 to expose the anterior opening 302, shifts internal components within the dispenser until the dispenser is locked open and the lever 307 becomes an activated reversion means, and drives the applicator 318 therethrough whereby a contained substance may be transferred to a target. As discussed below, the primary difference between the dispenser 301 and the earlier disclosed dispensers is that the presently disclosed dispenser 301 is particularly adapted to dispense substances that are less viscous, such as lacquers or stains (e.g., lip stains).

Figure 14A:
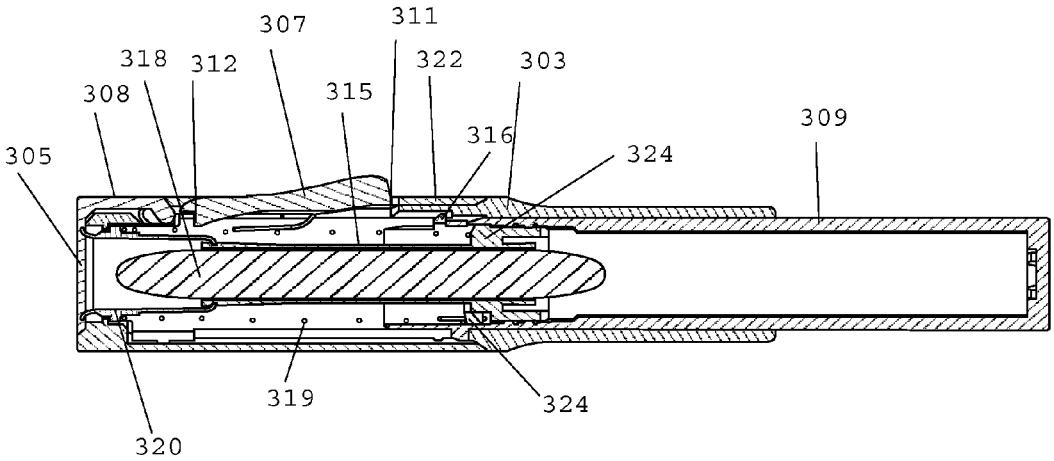
FIG. 14A is a longitudinal cross-section of the dispenser 301 of FIG. 11A.
Figure 14B:
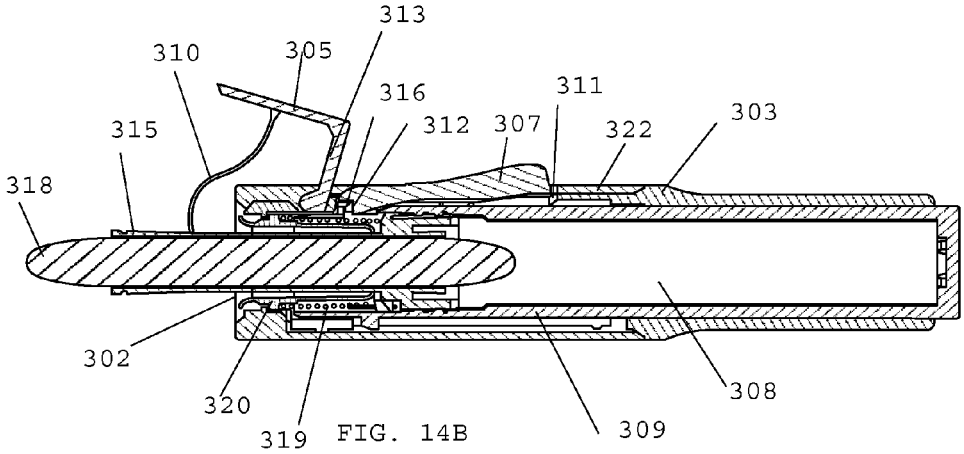
FIG. 14B is a longitudinal cross-section of the dispenser 301 of FIG. 11B.
Figure 15:
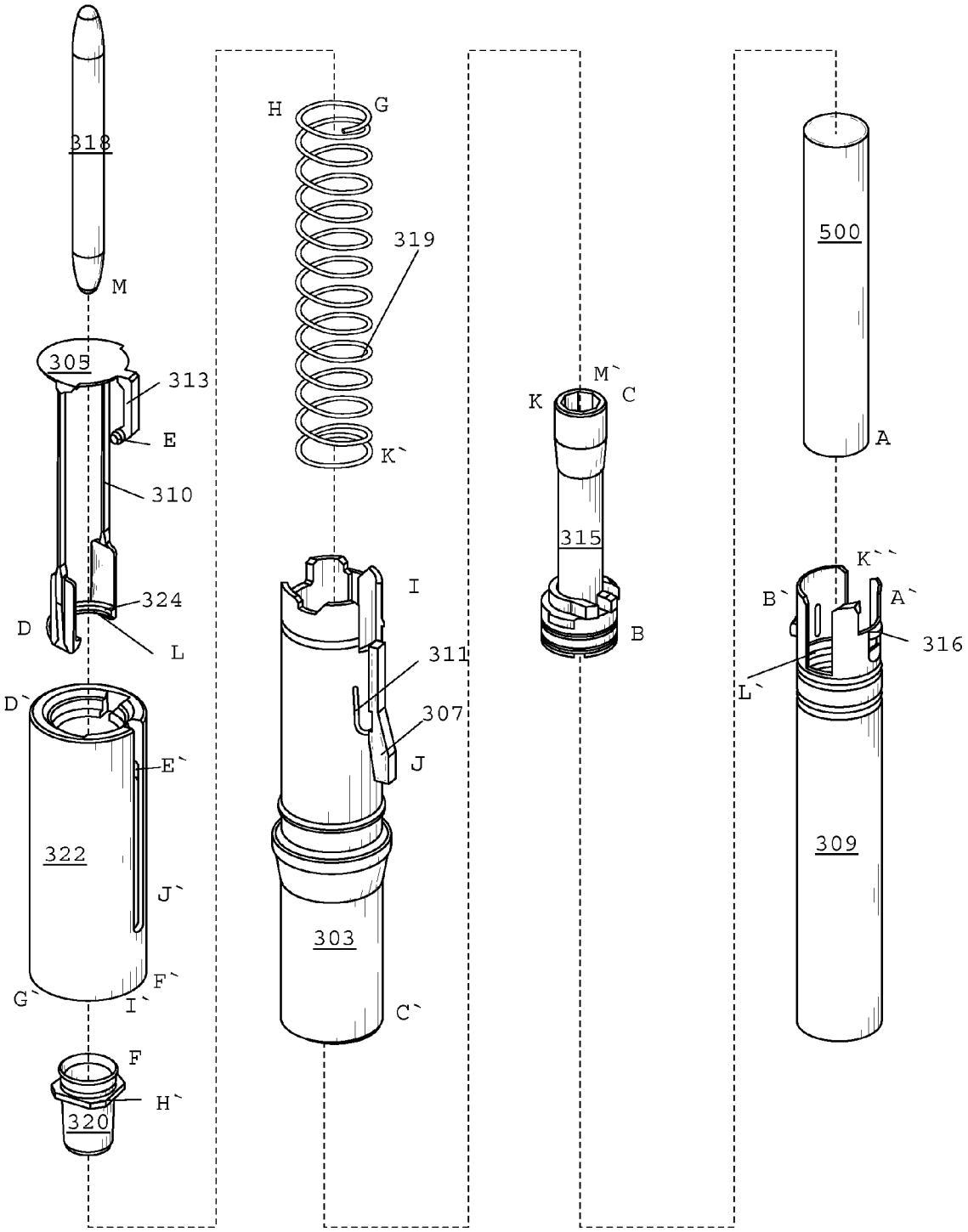
FIG. 15 is an exploded view of the dispenser 301 of FIGS. 13A and 13B.
Figure 16:
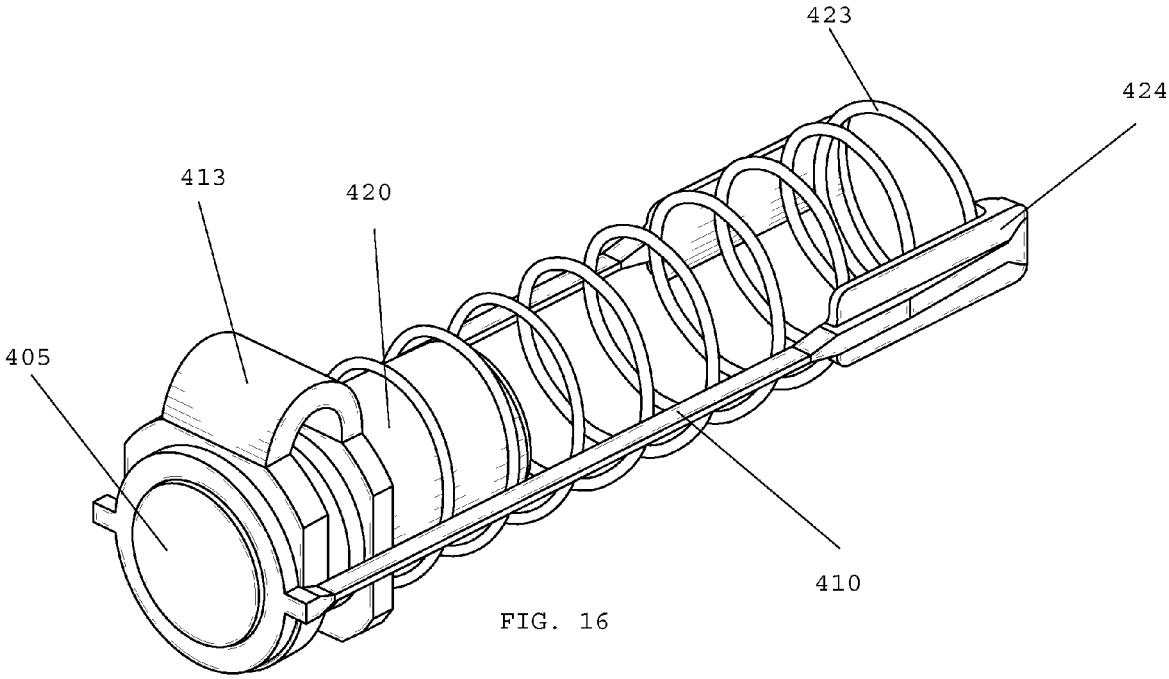
FIG. 16 is a perspective view of an alternate configuration for a closed cap and seal.
Figure 17:
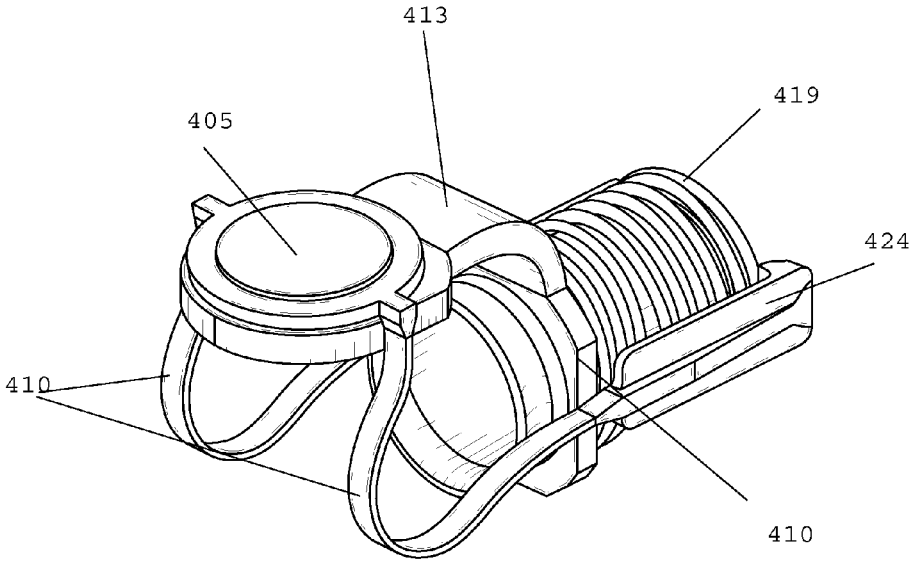
FIG. 17 is an alternate view of an open cap and seal.
Figure 18:
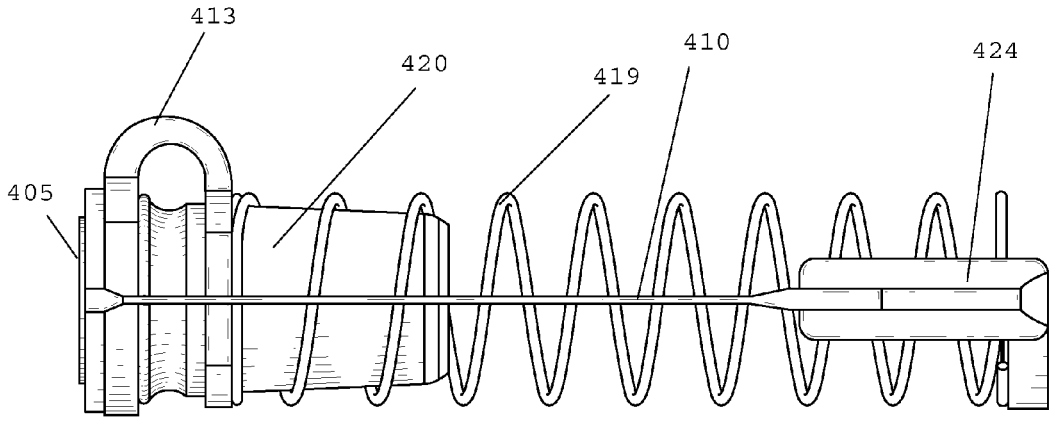
FIG. 18 is a side view of the cap and seal of FIG. 16
Figure 19:
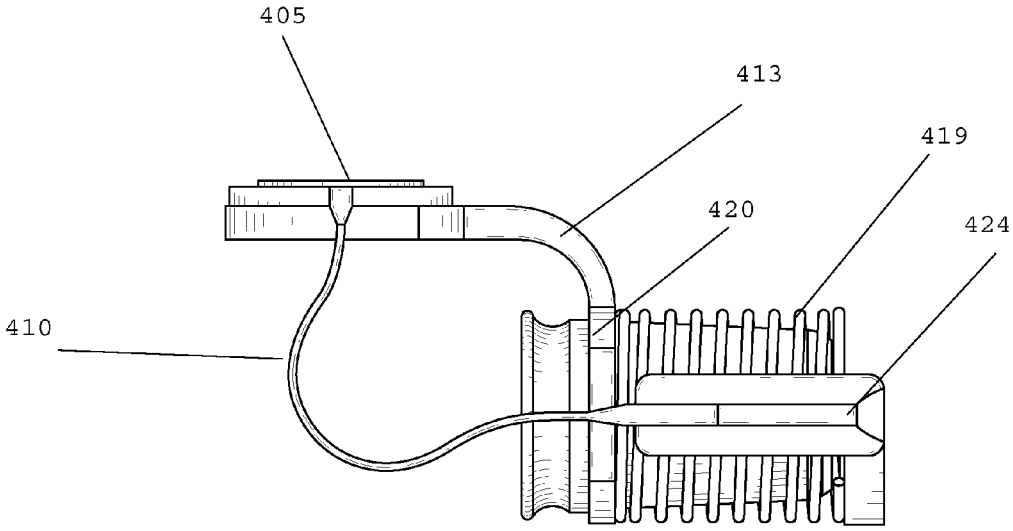
FIG. 19 is a side view of the cap and seal of FIG. 17
Figure 20:
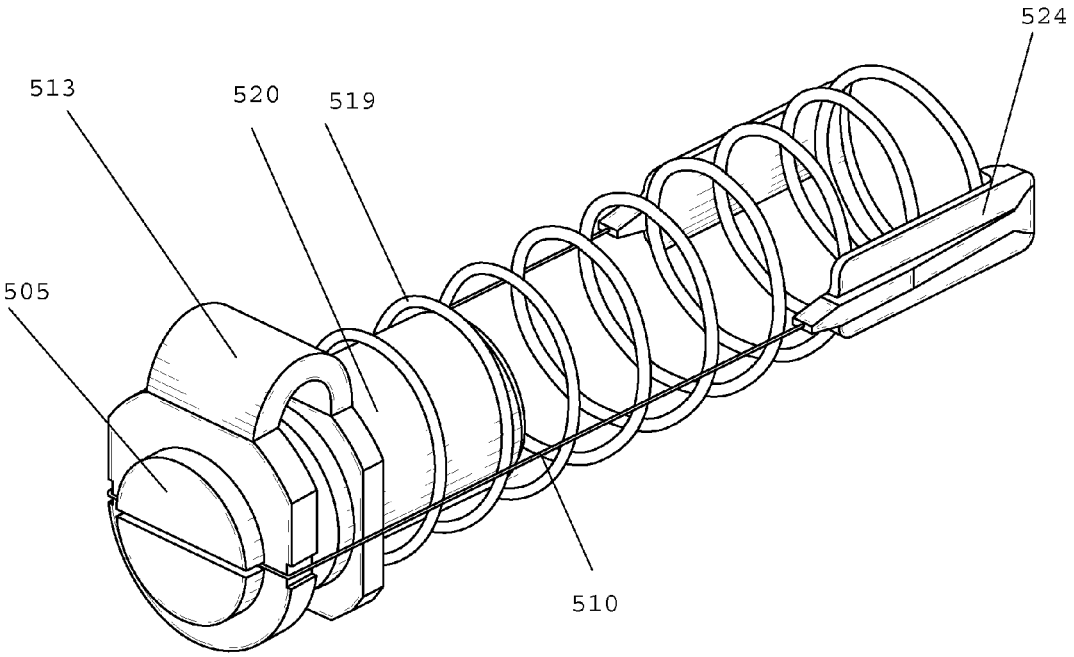
FIG. 20 is a perspective view of an alternate configuration for a closed cap and seal.
Figure 21:
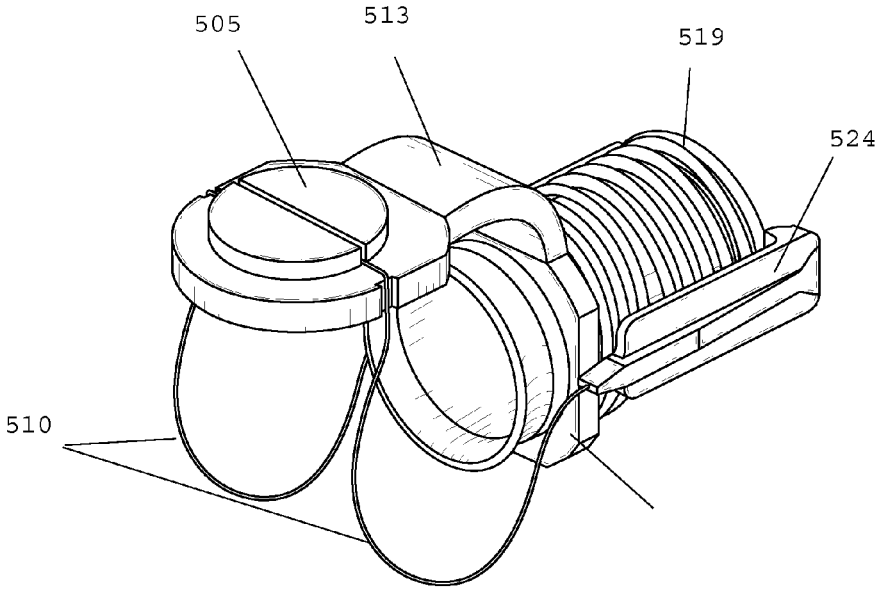
FIG. 21 is a perspective view of an open cap and seal.
Figure 22:
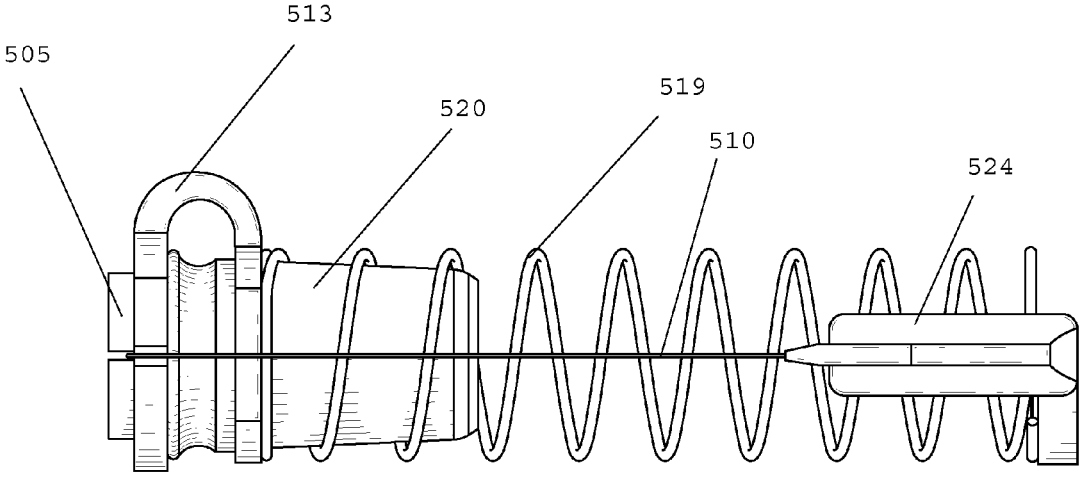
FIG. 22 is a side view of the cap and seal of FIG. 20.
Figure 23:
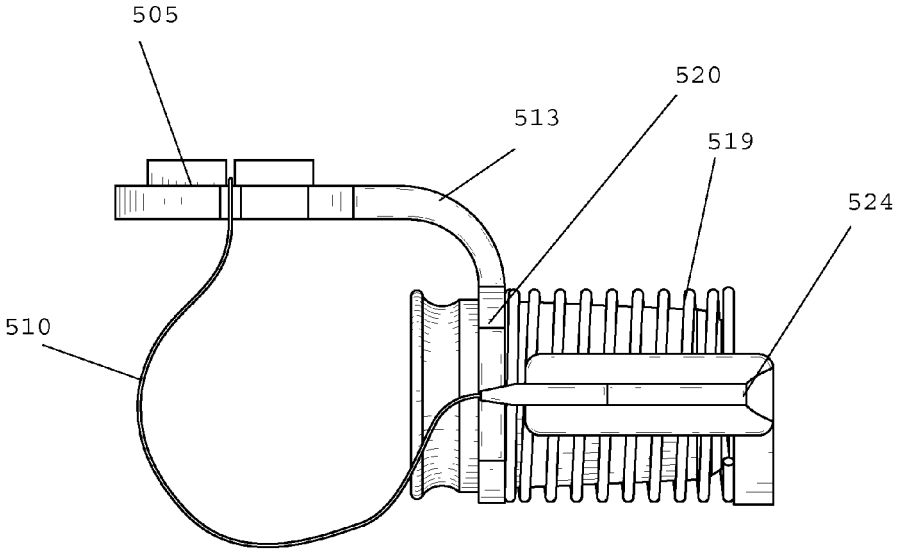
FIG. 23 is a side view of the cap and seal of FIG. 21.

FIGS. 14A and 14B respectively depict cross-sections of a closed and open dispenser 301 (because the figures are depicted in cross section, a detailed view of the components may be seen in the exploded view of the dispenser 301, FIG. 15). FIGS. 14A and 14B depict the components of the dispenser 301, namely: the cap 305; the cap shoots 310; the press 324; the cap housing 322; the body 303; the lever 307, with an edge 312 and slit 311; the spring 319; the spring stop 320; the cap shoots 310; the applicator 318; the shaft 315; the slot 316; and the plunger cavity 308 with a slot 316. In terms of opening and closing the dispenser, the cap housing 322, the cap 305, cap shoots 310, body 301, spring stop 320, spring 319, lever, and nub generally operate as disclosed above in connection with the earlier dispenser embodiments, as will readily be understood by those of skill in the art. However, unlike the earlier embodiments, the dispenser 301 preferably provides a contained substance to the applicator 318 via continual saturation of the applicator 318 with substance (whether by absorption therein, by capillary action therethrough, or by like phenomena) rather than the application of pressure to force a substance through a shaft. More specifically, referring to FIGS. 14A and 14B, an applicator 318 is disposed within a shaft 315 and extends into the plunger cavity 308 which is capable of containing a substance. Do to the physical properties of the applicator, the contained substance, and/or possibly gravity, the substance is driven through the applicator 318 whereby the applicator 318, when exposed as in FIG. 14B, may be directed to a target for selective transfer of the substance thereto.

FIG. 15 is an exploded view of the dispenser 301 depicted in the figures. FIG. 15 is also an inventory of parts, and a construction diagram for the dispenser 301. The components generally fit together by following the dashed line from the top left to the bottom right of the FIG. 15. More specifically, the applicator may be constructed as follows: (1) a substance 500 may be deposited into the plunger cavity 309; (2) the applicator 315 may be disposed within the plunger 309 to seal the plunger cavity 308 (B to B'); (3) the plunger and applicator 315 assembly may be inserted into the posterior opening 304 of the body 302 (C to C'); (4) the cap 305, cap shoot 310, and cap press 324 component may be installed on the cap housing 322 (D to D') whereby the stem 313 is pivotably attached thereto (E to E'); (5) the spring stop 320 may be inserted into the cap housing 322 (F to F'); (6) the spring 319 may be provided to the cap housing 322 (G to G') whereby the spring stop 320 and spring 319 interface (H to H') therein; (7) the body 303, and components assembled thereto, may be inserted into the cap housing 322 (I to I') whereby the lever 307 extends from the cap housing 322 (J to J'), the reservoir body 327 inserts into and receives the spring 319 (K to K', K' to K"); and the cap press 324 couples to the plunger 309 (L to L'); and, (13) the dispenser 301 may be opened as discussed above, and the applicator 318 may be provided to the shaft 315 (M to M') through the exposed anterior opening 302 of the dispenser 301.

After contained substance stock is sufficiently diminished by dispenser 301 use, the dispenser 301 may be disposed of or replenished with substance. If replenishment of substance is desired, usually the internal components are reset accordingly and the chamber re-stocked with substance. This application contemplates that a dispenser 301, and reservoir, may be either disposable or refillable.

The figures depict the dispenser 301 with a rigid but hollow tubular body 303, a rigid but hollow cylindrical plunger 309, and other components of various shapes and relative sizes. However, the body 303 and plunger 303 need not be tubular or cylindrical but may be any shape seen fit by a person skilled in the applicable art. In addition to cylinders, other shapes, including, but not limited to squared, polygonal shapes, may be employed. Similarly, the various components shape and relative size may also be so modified. For example, a dispenser 301 depicted by the figures may have the general appearance of a right cylinder, but the general appearance may also be that of any three-dimensional object.

The materials suitable for forming the dispenser 301 and its components will vary depending on the physical properties of the substance contained, and the nature of the expected dispenser 301 use. The proper combination of materials for contained substance will be readily apparent to those skilled in the art. Keeping that in mind, the components of a dispenser 301 may be formed using a variety of preferable materials, including but not limited to metals, alloys, composites, woods, and a variety of hard plastics including but not limited to high-density polyethylene, polypropylenes, PVC, and other materials that will be appreciated by those skilled in the art.

The materials suitable for use in the applicator may preferably be of porous or fibrous composition. For example, materials suitable for use may be selected from, but should not be limited to, felt or nylon. Those of skill in the art will know well the materials suitable for construction of an applicator 318.

FIGS. 16, 17, 18 and 19 illustrate another embodiment of a cap 405, cap shoot 410, press 424, and spring stop 420. Specifically, FIGS. 16, 17, 18 and 19 respectively illustrate a perspective view of a closed cap 405 and spring stop 420, a perspective view of an open cap 405 and spring stop 420, a side view of a closed cap 405 and spring stop 420, and a side view of an open cap 405 and spring stop 406. Unlike the embodiments disclosed above, the cap 405 of the present embodiment may be hingedly constructed to the spring stop 420 with the cap shoots 410 and cap press assembled thereto. Operably, compression of the spring 419 forces the cap away from the spring stop 420 in a similar manner to the earlier embodiments.

FIGS. 20, 21, 22 and 23 illustrate another embodiment of a cap 505, chords 510, press 524, and spring stop 520. Specifically, FIGS. 20, 21, 22 and 23 respectively illustrate a perspective view of a closed cap 505 and spring stop 520, a perspective view of an open cap 505 and spring stop 520, a side view of a closed cap 505 and spring stop 520, and a side view of an open cap 505 and spring stop 506. Unlike the embodiments disclosed above, the cap 505 of the present embodiment may be hingedly constructed to the spring stop 520 with the cables 510 and cap press 524 assembled thereto. Operably, compression of the spring 519 drives the press 524 toward the spring stop 520 and slackens the cables 510 whereby the cap 505 may be removed from the seal. When installed in a dispenser, an applicator may be moved to contact the cap 505 whereby the cap 505 moves off plain from the spring stop 520 so that the applicator may exit the dispenser unobstructedly.

It should be noted that in such dispenser embodiments, the mechanisms for opening the cap may vary according to the design of the dispenser. For instance, regarding the earlier disclosed dispensers 101, 201, and 301 any embodiment could be fitted with a cap press 424 whereby the cap 405 would open and close in a manner that is similar to that disclosed in reference to FIGS. 1-15. Further, the cap 505 may be molded to the spring stop 520 whereby the cap 505, in conjunction with the cables 510 would operate to close the dispenser 101, 201, 301 in a manner similar to that disclosed by US. Pub. Pat. App. Nos. 20090245919 (published Oct. 1, 2009) and 20080175648 (published Jul. 24, 2008).

It should be noted that FIGS. 1 through 23 and the associated description are of illustrative importance only. In other words, the depiction and descriptions of the present invention should not be construed as limiting of the subject matter in this application. For example, the cap and spring stop need not necessarily form a seal. Additional modifications may become apparent to one skilled in the art after reading this disclosure.

We claim:

1. A cosmetic dispenser comprising:

a reservoir configured to hold a substance;

a body housing said reservoir;

an applicator selectively extendable or retractable from the body through an opening;

a cap for electively exposing and closing said opening means for electively extending said applicator from said body and electively exposing said opening, said means comprising (1) a pair of cap shoots coupled to the cap and (2) at least one flexor that is mechanically coupled to the cap and housing so that said means operates by mechanically forcing the cap off the opening via the cap shoots and away from the path of the applicator via the flexor;

means for electively locking said applicator in an extended position when said applicator is extended from the body; and, means for ejecting the substance in the reservoir through the applicator.

2. The cosmetic dispenser of claim 1, further comprising a cap that may selectively conceal or reveal said applicator.

3. The cosmetic dispenser of claim 1, further comprising a release means for causing said applicator to move from a fixed extended position to a retracted position.

4. The cosmetic dispenser of claim 3, wherein said release means is a lever that breaks the interface of a slot and edge.

5. The cosmetic dispenser of claim 4, wherein said applicator further defines a brush.

6. The cosmetic dispenser of claim 1, wherein said substance is from any of the group of lip products consisting of any of lip-gloss, lip protector, or lipstick.

7. The cosmetic dispenser of claim 1, wherein said reservoir is transparent.

8. The cosmetic dispenser of claim 1, wherein said reservoir of said dispenser is movably disposed within the body, said body being defined by a transparent housing.

9. The dispenser of claim 1 wherein the means for extending the applicator from the dispenser is a plunger.

10. The dispenser of claim 1 wherein the dispenser is partially transparent.

11. The dispenser of claim 9 wherein the plunger interacts with the crank housing to turn the crank.

12. The dispenser of claim 1 wherein the means for ejecting the substance in the reservoir through the applicator is further comprises a porous applicator in contact with the substance.

13. The dispenser of claim 12 wherein the substance is a lip stain.

14. The cosmetic dispenser of claim 3 wherein a release means is a button that manipulates the interface of a slot on the reservoir and an edge of the lever.

15. A dispenser comprising:

a reservoir configured to hold a substance;

an applicator selectively extendable or retractable from the dispenser; and, wherein the applicator is porous and in contact with the substance as a means for ejecting the substance at an applicator tip when the applicator is extended, wherein the means for ejecting the substance in the reservoir through the applicator is a piston driven by the interaction of a driver, crank, and crank housing, said driver configured to turn said crank during depression of a plunger into the dispenser.

16. A method for applying a cosmetic substance comprising the steps of:

shifting a reservoir configured to hold the substance through a dispenser to open a cap via interaction with at least one cap shoot and to extend an applicator therefrom the dispenser through the opening, wherein cap (1) opens by mechanically force from the cap shoots and (2) is drawn away from the path of the applicator via a flexor;

causing the substance to eject at a tip of the applicator via a means for ejecting the substance, wherein the means for ejecting the substance in the reservoir through the applicator is a piston driven by the interaction of a driver, crank, and crank housing, said driver configured to turn said crank during depression of a plunger into the dispenser; and, directing the applicator tip and ejected substance to a target.

17. The method of claim 16, wherein the step of shifting the reservoir through the dispenser is accomplished via depressing the plunger to within the dispenser.

18. The method of claim 17 wherein the step of causing the substance to eject at a tip of the applicator is accomplished via further depressing the plunger.

19. The method of claim 17 wherein the step of causing the substance to eject at a tip of the applicator is accomplished by substance moving through a porous applicator in contact with the substance.

* * * * *